US008932789B2

(12) United States Patent
Sugimoto et al.

(10) Patent No.: US 8,932,789 B2
(45) Date of Patent: Jan. 13, 2015

(54) TONER AND DEVELOPER

(75) Inventors: Tsuyoshi Sugimoto, Shizuoka (JP); Hiroshi Yamashita, Shizuoka (JP); Daisuke Asahina, Shizuoka (JP); Satoyuki Sekiguchi, Shizuoka (JP); Rintaro Takahashi, Miyagi (JP); Masana Shiba, Shizuoka (JP); Yukari Fukuda, Miyagi (JP); Saki Konno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/593,956

(22) Filed: Aug. 24, 2012

(65) Prior Publication Data

US 2013/0059247 A1 Mar. 7, 2013

(30) Foreign Application Priority Data

Sep. 2, 2011 (JP) ..... 2011-191681

(51) Int. Cl.

*G03G 9/00* (2006.01)
*G03G 9/08* (2006.01)
*G03G 9/087* (2006.01)

(52) U.S. Cl.

CPC ..... *G03G 9/0821* (2013.01); *G03G 9/0825* (2013.01); *G03G 9/08755* (2013.01); *G03G 9/08795* (2013.01); *G03G 9/08797* (2013.01)
USPC ..... 430/109.4; 430/108.1; 430/109.1

(58) Field of Classification Search

CPC ..... G03G 9/08755; G03G 9/0825; G03G 9/08797; G03G 9/0821; G03G 9/08795
USPC ..... 430/108.1, 108.4, 108.8, 109.1, 109.4
See application file for complete search history.

(56) References Cited

U.S. PATENT DOCUMENTS

| | | | | |
|---|---|---|---|---|
| 6,326,115 | B1 | 12/2001 | Nakanishi et al. | |
| 2003/0219670 | A1 | 11/2003 | Sawada et al. | |
| 2005/0042534 | A1 | 2/2005 | Tanaka et al. | |
| 2006/0057488 | A1 | 3/2006 | Inoue et al. | |
| 2006/0204880 | A1 | 9/2006 | Mizutani et al. | |
| 2010/0035170 | A1 | 2/2010 | Sugimoto et al. | |
| 2010/0196817 | A1* | 8/2010 | Sasaki et al. | 430/109.4 |
| 2010/0310980 | A1 | 12/2010 | Sugimoto et al. | |
| 2011/0076612 | A1 | 3/2011 | Awamura et al. | |
| 2011/0223532 | A1 | 9/2011 | Sugimoto et al. | |
| 2011/0262856 | A1 | 10/2011 | Sugimoto et al. | |
| 2011/0294061 | A1* | 12/2011 | Shirai et al. | 430/109.1 |
| 2012/0052431 | A1 | 3/2012 | Hozumi et al. | |
| 2012/0052434 | A1* | 3/2012 | Sugimoto et al. | 430/108.8 |
| 2012/0064447 | A1 | 3/2012 | Hozumi et al. | |
| 2012/0082926 | A1 | 4/2012 | Suzuki et al. | |
| 2012/0122027 | A1 | 5/2012 | Watanabe et al. | |

FOREIGN PATENT DOCUMENTS

| | | | | |
|---|---|---|---|---|
| CN | 101794092 | A | 8/2010 | |
| CN | 101907838 | A | 12/2010 | |
| JP | 2579150 | | 11/1996 | |
| JP | 11-133665 | | 5/1999 | |
| JP | 2001-158819 | | 6/2001 | |
| JP | 2002-287400 | | 10/2002 | |
| JP | 2002-351143 | | 12/2002 | |
| JP | 2004-046095 | | 2/2004 | |
| JP | 2004-309718 | * | 4/2004 | G03G 9/08 |
| JP | 2004-302458 | | 10/2004 | |
| JP | 2006-003680 | | 1/2006 | |
| JP | 2006-018018 | | 1/2006 | |
| JP | 2006-78707 | A | 3/2006 | |
| JP | 2006-084743 | | 3/2006 | |
| JP | 2006-251564 | | 9/2006 | |
| JP | 2006-349894 | | 12/2006 | |
| JP | 2007-65620 | A | 3/2007 | |
| JP | 2007-156082 | | 6/2007 | |
| JP | 2007-271789 | | 10/2007 | |
| JP | 2008-165017 | | 7/2008 | |
| JP | 2009-229920 | | 10/2009 | |
| JP | 2010-139752 | A | 6/2010 | |
| JP | 2010-170151 | | 8/2010 | |
| JP | 2010-181438 | A | 8/2010 | |
| JP | 2011-018030 | A | 1/2011 | |
| JP | 2011-112840 | A | 6/2011 | |
| JP | 2011-123483 | | 6/2011 | |
| JP | 2011-242750 | | 12/2011 | |
| JP | 2012-063559 | | 3/2012 | |
| WO | WO2011/052794 | A1 | 5/2011 | |

OTHER PUBLICATIONS

U.S. Appl. No. 13/336,318, filed Dec. 23, 2011, Tsuyoshi Sugimoto, et al.
U.S. Appl. No. 13/399,346, filed Feb. 17, 2012, Tsuyoshi Sugimoto, et al.
U.S. Appl. No. 13/086,007, filed Apr. 13, 2011, Yasuaki Iwamoto, et al.
Combined Chinese Office Action and Search Report issued Jan. 16, 2014 in Patent Application No. 201210321218.8 with English Translation and English Translation of Category of Cited Documents.
Office Action issued Aug. 20, 2013 in Japanese Patent Application No. 2011-191681.

* cited by examiner

*Primary Examiner* — Christopher Rodee
*Assistant Examiner* — Omar Kekia
(74) *Attorney, Agent, or Firm* — Oblon, Spivak, McClelland, Maier & Neustadt, L.L.P.

(57) ABSTRACT

To provide a toner, which contains: a non-crystalline polyester resin A obtained through a reaction between a non-linear chain reactive precursor and a curing agent, and having a glass transition temperature of −60° C. to 0° C.; a non-crystalline polyester resin B having a glass transition temperature of 40° C. to 70° C.; and a crystalline polyester resin C, wherein the toner has a glass transition temperature Tg1st of 20° C. to 40° C. as measured with first heating in differential scanning calorimetry (DSC).

12 Claims, No Drawings

TONER AND DEVELOPER

BACKGROUND OF THE INVENTION

1. Field of the Invention

The present invention relates a toner and a developer.

2. Description of the Related Art

In recent years, toner have been desired to have small particles size and hot offset resistance for giving high quality output images, low temperature fixing ability for energy saving, and heat resistant storage stability for resisting high temperature and high humidity environments during storage or transport after production. Particularly, low temperature fixing ability is very important quality of a toner, as power consumption for fixing occupies a large part in the power consumption for an entire image forming process.

Conventionally, toners produced by a kneading and pulverizing method have been used. The toner produced by the kneading and pulverizing method have problems that it is difficult to reduce the particle size thereof, and shapes of particles are uneven and a particle diameter distribution thereof is broad, which result in unsatisfactory quality of output images, and a large quantity of energy is required for fixing such toner. In the case where wax (i.e., a releasing agent) is added to the toner for improving fixing ability, moreover, the toner produced by the kneading and pulverizing method contains a large amount of the wax present near toner surfaces, as a kneaded product is cracked from an interface of wax during pulverizing. As a result of this, a releasing effect is exhibited, but on the other hand, the toner tends to cause toner deposition (i.e., filming) on a carrier, a photoconductor, and a blade. Therefore, such toner is not satisfactory in view of its characteristics on the whole.

To encounter the aforementioned problems associated with the kneading and pulverizing method, a production method of a toner in accordance with a polymerization method has been proposed. A toner produced by the polymerization method is easily produced as small particles, has a sharp particle diameter distribution compared to that of the toner produced by the pulverizing method, and can encapsulate a releasing agent therein. As a production method of a toner in accordance with the polymerization method, proposed is a method for producing a toner using an elongation reaction product of urethane-modified polyester as a toner binder, for the purpose of improving low temperature fixing ability, and hot offset resistance (see, for example, Japanese Patent Application Laid-Open (JP-A) No. 11-133665).

Moreover, proposed is a production method of a toner, which is excellent in all of heat resistant storage stability, low temperature fixing ability, and hot offset resistance, as well as excellent in powder flowability and transfer ability, when a toner is produced as a small-diameter toner (see, for example, JP-A Nos. 2002-287400 and 2002-351143).

Further, disclosed is a production method of a toner having a maturing step for producing a toner binder having a stable molecular weight distribution, and achieving both low temperature fixing ability and (see, for example, Japanese Patent (JP-B) No. 2579150 and JP-A No. 2001-158819).

However, these proposed techniques do not provide a toner having a high level of low temperature fixing ability, which has been demanded in recent years.

For the purpose of achieving a high level of low temperature fixing ability, therefore, proposed is a toner containing a resin including a crystalline polyester resin, and a releasing agent, and having a phase separation structure, where the resin and the releasing agent (e.g. wax) are incompatible to each other in the form of sea-islands (see, for example, JP-A No. 2004-46095).

Moreover, proposed is a toner containing a crystalline polyester resin, a releasing agent, and a graft polymer (see, for example, JP-A No. 2007-271789).

These proposed techniques can achieve low temperature fixing, as the crystalline polyester resin is rapidly melted, compared to a non-crystalline polyester resin. Even when the crystalline polyester resin, which forms islands in the sea-island phase separation structure, is melted, however, the non-crystalline polyester resin, which forms sea occupying the majority of the structure, is not yet melted. Since fixing cannot be carried out unless both the crystalline polyester resin, and the non-crystalline polyester resin are melted to a certain extent, these techniques do not achieve a high level of low temperature fixing ability, a level of which has been desired to be higher.

Accordingly, there are currently needs for a toner, which have excellent low temperature fixing ability, hot offset resistance, and heat resistant storage stability, without causing filming.

SUMMARY OF THE INVENTION

The present invention aims to solve the aforementioned various problems in the art, and to achieve the following object. An object of the present invention is to provide a toner, which has excellent low temperature fixing ability, hot offset resistance, and heat resistant storage stability, without causing filming.

The means for solving the aforementioned problems are as follows:

A toner, which contains:

a non-crystalline polyester resin A obtained through a reaction between a non-linear chain reactive precursor and a curing agent, and having a glass transition temperature of −60° C. to 0° C.;

a non-crystalline polyester resin B having a glass transition temperature of 40° C. to 70° C.; and a crystalline polyester resin C, wherein the toner has a glass transition temperature Tg1st of 20° C. to 40° C. as measured with first heating in differential scanning calorimetry (DSC).

The present invention can solve the aforementioned problems in the art and can provide a toner, which has excellent low temperature fixing ability, hot offset resistance, and heat resistant storage stability, without causing filming.

DETAILED DESCRIPTION OF THE INVENTION (Toner)

The toner of the present invention contains at least a non-crystalline polyester resin A, a non-crystalline polyester resin B, and a crystalline polyester resin C, and may further contain other components, if necessary.

The non-crystalline polyester resin A is obtained through a reaction between a non-linear chain reactive precursor and a curing agent, and has a glass transition temperature of −60° C. to 0° C.

The non-crystalline polyester resin B has a glass transition temperature of 40° C. to 70° C.

The toner has a glass transition temperature Tg1st of 20° C. to 40° C., where the Tg1st is a glass transition temperature of the toner as measured with first heating in differential scanning calorimetry (DSC).

In order to further enhance low temperature fixing ability of a toner, there are a method for lowering glass transition temperature of the non-crystalline polyester resin to make the non-crystalline polyester resin melt with a crystalline polyester resin, and a method for reducing a molecular weight of the non-crystalline polyester resin. In the case where a melt viscosity is reduced simply by lowering the glass transition temperature or reducing the molecular weight of the non-crystalline polyester resin, however, it is easily expected that heat resistant storage stability of a toner, and hot offset resistance of a toner during fixing are impaired.

Conversely, in the toner of the present invention, the non-crystalline polyester resin A has extremely low glass transition temperature and therefore has properties capable of deforming at low temperature. Accordingly, the toner of the present invention deforms with heat and pressure applied during fixing, and has characteristics for easily adhering to a recording medium, such as paper, at even lower temperature than conventional art. Since the non-crystalline polyester resin A is formed from a reactive precursor having a non-linear chain structure, moreover, the non-crystalline polyester resin has a branched chain structure in a molecular skeleton thereof, and the molecular chain thereof is a three dimensional network structure. Therefore, the non-crystalline polyester resin A deforms at low temperature, but has rubber-like characteristics, where the non-crystalline polyester resin A does not flow out. Accordingly, the toner can be provided with heat resistant storage stability, and hot offset resistance. Note that, in the case where the non-crystalline polyester resin A has a urethane bond or urea bond having high cohesive energy, a resulting toner has even more excellent adhesion to a recording medium, such as paper. Moreover, the urethane bond or urea bond exhibits behaviors like those of a crosslink point, and therefore rubber-like characteristics are enhanced. As a result, the heat resistant storage stability and hot offset resistance of the toner are further improved.

Specifically, the toner of the present invention has glass transition temperature in the extremely low temperature range. Since the non-crystalline polyester resin A, which has high melt viscosity and is hardly flow, is used in combination with the non-crystalline polyester resin B, and the crystalline polyester resin C in the toner, the toner attains heat resistance storage stability and hot offset resistance even through the glass transition temperature of the toner is set a lot lower than that of the conventional toner. In addition, the toner has excellent low temperature fixing ability as the glass transition temperature of the toner is set low.

<Non-Crystalline Polyester Resin A>

The non-crystalline polyester resin A is obtained through a reaction between a non-linear chain reactive precursor and a curing agent, and has a glass transition temperature of −60° C. to 0° C.

The non-crystalline polyester resin A preferably contains a urethane bond, or a urea bond, or both thereof in view of excellent adhesion to a recording medium, such as paper. By having the urethane bond and/or urea bond in the non-crystalline polyester resin A, the urethane bond or urea bond exhibits behavior similar to a crosslink point, which enhances rubber-like characteristics of the non-crystalline polyester resin A, and improves heat resistant storage stability and hot offset resistance of a toner.

—Non-Linear Chain Reactive Precursor—

The non-linear chain reactive precursor is appropriately selected depending on the intended purpose without any limitation, provided that it is a polyester resin having a group reactable with the curing agent (also referred to as "prepolymer" hereinafter).

Examples of the group reactable with the curing agent contained in the prepolymer include a group reactable with an active hydrogen group. Examples of the group reactable with an active hydrogen group including an isocyanate group, an epoxy group, carboxylic acid, and an acid chloride group. Among them, an isocyanate group is preferable because it allows introducing a urethane bond or urea bond to the non-crystalline polyester resin.

The prepolymer has a non-linear chain structure. The non-linear chain structure means a branched chain structure imparted by at least either trihydric or higher alcohol, or trivalent or higher carboxylic acid.

The prepolymer is preferably a polyester resin containing an isocyanate group.

—Polyester Resin Containing Isocyanate Group—

The polyester resin containing an isocyanate group is appropriately selected depending on the intended purpose without any limitation, and examples thereof include a reaction product between a polyester resin containing an active hydrogen group and polyisocyanate. The polyester resin containing an active hydrogen group can be obtained, for example, through polycondensation of diol, dicarboxylic acid, and at least either trihydric or higher alcohol, or trivalent or higher carboxylic acid. The trihydric or higher alcohol and the trivalent or higher carboxylic acid impart a branched chain structure to the polyester resin containing an isocyanate group.

—Diol—

The diol is appropriately selected depending on the intended purpose without any limitation, and examples thereof include: aliphatic diol, such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; diol containing an oxyalkylene group, such as diethylene glycol, triethylene glycol, dipropylene glycol, polyethylene glycol, polypropylene glycol, and polytetramethylene glycol; alicyclic diol such as 1,4-cyclohexanedimethanol, and hydrogenated bisphenol A; alkylene oxide (e.g., ethylene oxide, propylene oxide, butylene oxide) adducts of alicyclic diol; bisphenol, such as bisphenol A, bisphenol F, and bisphenol S; and alkylene oxide adducts of bisphenols, such as those prepared by addition polymerization of bisphenols with alkylene oxide (e.g., ethylene oxide, propylene oxide, and butylene oxide). Among them, C4-C12 aliphatic diol is preferable.

These diols may be used independently, or in combination.

—Dicarboxylic Acid—

The dicarboxylic acid is appropriately selected depending on the intended purpose without any limitation, and examples thereof include aliphatic dicarboxylic acid, and aromatic dicarboxylic acid. Also, anhydrides thereof may be used, lower (C1-C3) alkyl esters thereof may be used, or halogenated compounds thereof may be used.

The aliphatic dicarboxylic acid is appropriately selected depending on the intended purpose without any limitation, and examples thereof include succinic acid, adipic acid, sebacic acid (decanedioic acid), dodecanedioic acid, maleic acid, and fumaric acid.

The aromatic dicarboxylic acid is appropriately selected depending on the intended purpose without any limitation, but it is preferably C8-C20 aromatic dicarboxylic acid. The C8-C20 aromatic dicarboxylic acid is appropriately selected depending on the intended purpose without any limitation, and examples thereof include phthalic acid, isophthalic acid, terephthalic acid, and naphthalene dicarboxylic acid.

Among them, C4-C12 aliphatic dicarboxylic acid is preferable.

These dicarboxylic acids may be used independently or in combination.

—Trihydric or Higher Alcohol—

The trihydric or higher alcohol is appropriately selected depending on the intended purpose without any limitation, and examples thereof include trihydric or higher aliphatic alcohol, trihydric or higher polyphenol, and an alkylene oxide adduct of trihydric or higher polyphenol.

Examples of the trihydric or higher aliphatic alcohol include glycerin, trimethylol ethane, trimethylol propane, pentaerythritol, and sorbitol.

Examples of the trihydric or higher polyphenol include trisphenol PA, phenol novolak, and cresol novolak.

Examples of the alkylene oxide adduct of the trihydric or higher polyphenol include alkylene oxide (e.g. ethylene oxide, propylene oxide, and butylene oxide) adducts of trihydric or higher polyphenol.

—Trivalent or Higher Carboxylic Acid—

The trivalent or higher carboxylic acid is appropriately selected depending on the intended purpose without any limitation, and examples thereof include trivalent or higher aromatic carboxylic acid. Moreover, anhydride thereof may be used, lower (C1-C3) alkyl esters thereof may be used, and halogenated compounds thereof may be used.

The trivalent or higher aromatic carboxylic acid is preferably C9-C20 trivalent or higher aromatic carboxylic acid. Examples of the C9-C20 trivalent or higher aromatic carboxylic acid include trimellitic acid, and pyromellitic acid.

—Polyisocyanate—

The polyisocyanate is appropriately selected depending on the intended purpose without any limitation, and examples thereof include diisocyanate, and trivalent or higher isocyanate.

Examples of the diisocyanate include: aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

The aliphatic diisocyanate is appropriately selected depending on the intended purpose without any limitation, and examples thereof include tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is appropriately selected depending on the intended purpose without any limitation, and examples thereof include isophorone diisocyanate, and cyclohexylmethane diisocyanate.

The aromatic diisocyanate is appropriately selected depending on the intended purpose without any limitation, and examples thereof include tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane, and 4,4'-diisocyanato-diphenyl ether.

The aromatic aliphatic diisocyanate is appropriately selected depending on the intended purpose without any limitation, and examples thereof include $\alpha,\alpha,\alpha',\alpha'$-tetramethylxylene diisocyanate.

The isocyanurate is appropriately selected depending on the intended purpose without any limitation, and examples thereof include tris(isocyanatoalkyl)isocyanurate, and tris (isocyanatocycloalkyl)isocyanurate.

These polyisocyanates may be used independently, or in combination.

—Curing Agent—

The curing agent is appropriately selected depending on the intended purpose without any limitation, provided that it reacts with the non-linear chain reactive precursor to generate the non-crystalline polyester resin A, and examples thereof include an active hydrogen group-containing compound.

—Active Hydrogen Group-Containing Compound—

An active hydrogen group in the active hydrogen group-containing compound is appropriately selected depending on the intended purpose without any limitation, and examples thereof include a hydroxyl group (e.g., an alcoholic hydroxyl group, and a phenolic hydroxyl group), an amino group, a carboxyl group, and a mercapto group. These may be used independently, or in combination.

The active hydrogen group-containing compound is appropriately selected depending on the intended purpose without any limitation, but it is preferably selected from amines, as the amines can form a urea bond.

The amines are appropriately selected depending on the intended purpose without any limitation, and examples thereof include diamine, trivalent or higher amine, amino alcohol, amino mercaptan, amino acid, and compounds in which the amino groups of the foregoing compounds are blocked. These may be used independently, or in combination.

Among them, diamine, and a mixture of diamine and a small amount of trivalent or higher amine are preferable.

The diamine is appropriately selected depending on the intended purpose without any limitation, and examples thereof include aromatic diamine, alicyclic diamine, and aliphatic diamine. The aromatic diamine is appropriately selected depending on the intended purpose without any limitation, and examples thereof include phenylene diamine, diethyl toluene diamine, and 4,4'-diaminodiphenyl methane. The alicyclic diamine is appropriately selected depending on the intended purpose without any limitation, and examples thereof include 4,4'-diamino-3,3'-dimethyldicyclohexyl methane, diaminocyclohexane, and isophorone diamine. The aliphatic diamine is appropriately selected depending on the intended purpose without any limitation, and examples thereof include ethylene diamine, tetramethylene diamine, and hexamethylene diamine.

The trivalent or higher amine is appropriately selected depending on the intended purpose without any limitation, and examples thereof include diethylene triamine, and triethylene tetramine.

The amino alcohol is appropriately selected depending on the intended purpose without any limitation, and examples thereof include ethanol amine, and hydroxyethyl aniline.

The aminomercaptan is appropriately selected depending on the intended purpose without any limitation, and examples thereof include aminoethyl mercaptan, and aminopropyl mercaptan.

The amino acid is appropriately selected depending on the intended purpose without any limitation, and examples thereof include aminopropionic acid, and aminocaproic acid.

The compound where the amino group is blocked is appropriately selected depending on the intended purpose without any limitation, and examples thereof include a ketimine compound where the amino group is blocked with ketone such as acetone, methyl ethyl ketone, methyl isobutyl ketone, and an oxazoline compound.

In order to reduce Tg of the non-crystalline polyester resin A, and to impart deformable characteristics at low temperature, the non-crystalline polyester resin A contains a diol component as a constitutional component, and the diol component preferably contains C4-C12 aliphatic diol in an amount of 50% by mass or greater.

Moreover, in order to reduce the Tg of the non-crystalline polyester resin A, and to impart deformable characteristics at low temperature, it is preferred that the non-crystalline polyester resin A contain 50% by mass or greater of C4-C12 aliphatic diol relative to the entire alcohol components.

In order to reduce the Tg of the non-crystalline polyester resin A, and to impart deformable characteristics at low temperature, the non-crystalline polyester resin A contains a dicarboxylic acid component as a constitutional component, and the dicarboxylic acid component preferably contains C4-C12 aliphatic dicarboxylic acid in an amount of 50% by mass or greater.

The glass transition temperature of the non-crystalline polyester resin A is −60° C. to 0° C., preferably −40° C. to −20° C. When the glass transition temperature thereof is lower than −60° C., flow of the toner cannot be suppressed at low temperature, which impairs heat resistant storage stability and filming resistance of the toner. When the glass transition temperature thereof is higher than 0° C., the toner cannot be sufficiently deformed with heat and pressure applied during fixing, and therefore low temperature fixing ability of the toner is insufficient.

The weight average molecular weight of the non-crystalline polyester resin A is appropriately selected depending on the intended purpose without any limitation, but it is preferably 20,000 to 1,000,000 as measured by gel permeation chromatography (GPC). The weight average molecular weigh of the non-crystalline polyester resin A is a molecular weight of a reaction product obtained through a reaction between the non-linear chain reactive precursor and the curing agent. When the weight average molecular weight thereof is smaller than 20,000, the toner tends to flow at low temperature, and heat resistant storage stability of the toner may be impaired. Moreover, the viscosity of the melted toner is low, which may impair the hot offset resistance of the toner.

A molecular structure of the non-crystalline polyester resin A can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-crystalline polyester resin A is appropriately selected depending on the intended purpose without any limitation, but it is preferably 5 parts by mass to 25 parts by mass, and more preferably 10 parts by mass to 20 parts by mass, relative to 100 parts by mass of the toner. When the amount thereof is smaller than 5 parts by mass, low temperature fixing ability, and hot offset resistance of a resulting toner may be impaired. When the amount thereof is greater than 25 parts by mass, heat resistant storage stability of the toner may be impaired, and glossiness of an image obtained after fixing may reduce. When the amount thereof is within the aforementioned more preferable range, it is advantageous because all of the low temperature fixing ability, hot offset resistance, and heat resistant storage stability excel.

<Non-Crystalline Polyester Resin B>

The non-crystalline polyester resin B is appropriately selected depending on the intended purpose without any limitation, provided that it has a glass transition temperature of 40° C. to 70° C.

The non-crystalline polyester resin B is preferably a linear chain polyester resin.

The non-crystalline polyester resin B is preferably a non-modified polyester resin. The non-modified polyester resin is a polyester resin obtained from polyhydric alcohol and polyvalent carboxylic acid (e.g., polyvalent carboxylic acid, polyvalent carboxylic acid anhydride, and polyvalent carboxylic acid ester) or derivative thereof, and is a polyester resin which has not been modified with an isocyanate compound.

Examples of the polyhydric alcohol include diol.

Examples of the diol include: (C2-C3)alkylene oxide adduct (average number of moles added: 1 to 10) of bisphenol A, such as polyoxypropylene (2.2)-2,2-bis(4-hydroxyphenyl)propane, and polyoxyethylene(2.2)-2,2-bis(4-hydroxyphenyl)propane; ethylene glycol, and propylene glycol; hydrogenated bisphenol A, and (C2-C3) alkylene oxide adduct (average number of moles added: 1 to 10) of hydrogenated bisphenol A.

These may be used independently, or in combination.

Examples of the polyvalent carboxylic acid include dicarboxylic acid.

Examples of the dicarboxylic acid include: adipic acid, phthalic acid, isophthalic acid, terephthalic acid, fumaric acid, and maleic acid; and succinic acid substituted by a C1-C20 alkyl group or C2-C20 alkenyl group, such as dodecenyl succinate, and octyl succinate.

These may be used independently, or in combination.

For the purpose of controlling an acid value and hydroxyl value, the non-crystalline polyester resin B may contain at least either trivalent or higher carboxylic acid, or trihydric or higher alcohol at a terminal of the molecular chain of the resin.

Examples of the trivalent or higher carboxylic acid include trimellitic acid, pyromellitic acid, and anhydride thereof.

Examples of the trihydric or higher alcohol include glycerin, pentaerythritol, and trimethylol propane.

A molecular weight of the non-crystalline polyester resin B is appropriately selected depending on the intended purpose without any limitation. When the molecular weight thereof is excessively small, heat resistant storage stability of the toner, resistance of the toner to stress, such as stirring in a developing unit may be impaired in some cases. When the molecular weight thereof is excessively large, the viscoelasticity of the toner increases during melting, which may impair low temperature fixing ability of the toner. Accordingly, the non-crystalline polyester resin B preferably has the weight average molecular weight (Mw) of 3,000 to 10,000, as measured by gel permeation chromatography (GPC). Moreover, the number average molecular weight (Mn) thereof is preferably 1,000 to 4,000. Moreover, the value of Mw/Mn is preferably 1.0 to 4.0.

The weight average molecular weight (Mw) thereof is more preferably 4,000 to 7,000. The number average molecular weight (Mn) is more preferably 1,500 to 3,000. The Mw/Mn is more preferably 1.0 to 3.5.

An acid value of the non-crystalline polyester resin B is appropriately selected depending on the intended purpose without any limitation, but it is preferably 1 mgKOH/g to 50 mgKOH/g, more preferably 5 mgKOH/g to 30 mgKOH/g. When the acid value is 1 mgKOH/g or greater, the toner tends to be negatively charged, and moreover, an affinity between paper and the toner improves during fixing to paper, which increase low temperature fixing ability of the toner. When the acid value is greater than 50 mgKOH/g, charge stability, especially charge stability to environmental variation, may lower.

A hydroxyl value of the non-crystalline polyester resin B is appropriately selected depending on the intended purpose without any limitation, but it is preferably 5 mgKOH/g or greater.

A glass transition temperature (Tg) of the non-crystalline polyester resin B is 40° C. to 70° C., preferably 50° C. to 60° C. When the glass transition temperature thereof is lower than 40° C., heat resistant storage stability of the toner, resistance of the toner to stress, such as stirring in a developing unit, and filming resistance may be impaired. When the glass transition temperature thereof is higher than 70° C., deformation of the toner with heat and pressure applied during the fixing of the toner may not be sufficient, which may lead to insufficient low temperature fixing ability of the toner.

A molecular structure of the non-crystalline polyester resin B can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-crystalline polyester resin B is appropriately selected depending on the intended purpose without any limitation, but it is preferably 50 parts by mass to 90 parts by mass, more preferably 60 parts by mass to 80 parts by mass, relative to 100 parts by mass of the toner. When the amount thereof is smaller than 50 parts by mass, dispersibility of the pigment and the releasing agent in the toner is impaired, which may cause fogging or disturbance of an image. When the amount thereof is greater than 90 parts by mass, low temperature fixing ability of the toner may be poor, as amounts of the crystalline polyester resin C, and non-crystalline polyester resin A are small. When the amount thereof is within the aforementioned more preferable range, it is advantageous because all of high image quality and low temperature fixing ability of the toner excel.

<Crystalline Polyester Resin C>

The crystalline polyester resin C exhibits thermofusion characteristics in which viscosity is drastically decreases at temperature around fixing onset temperature, as the crystalline polyester resin C has high crystallinity. By using the crystalline polyester resin C having the aforementioned characteristics together with the non-crystalline polyester resin B in the toner, the heat resistance storage stability of the toner is excellent up to the melt onset temperature owing to crystallinity, and the toner drastically decreases its viscosity (sharp melt) at the melt onset temperature because of melting of the crystalline polyester resin C. Along with the sharp melt, the non-crystalline polyester resin C is melt together with the non-crystalline polyester resin B, to drastically decrease their viscosity to thereby be fixed. Accordingly, a toner having excellent heat resistant storage stability and low temperature fixing ability can be obtained. Moreover, the toner has excellent results in terms of a releasing width (a difference between the minimum fixing temperature and hot offset occurring temperature).

The crystalline polyester resin C is obtained from polyhydric alcohol, and polyvalent carboxylic acid (e.g. polyvalent carboxylic acid, polyvalent carboxylic acid anhydride, and polyvalent carboxylic acid ester) or derivative thereof.

Note that, in the present invention, the crystalline polyester resin C is one obtained from polyhydric alcohol, and polyvalent carboxylic acid (e.g. polyvalent carboxylic acid, polyvalent carboxylic acid anhydride, and polyvalent carboxylic acid ester) or derivative thereof, as described above, and a resin obtained by modifying a polyester resin, for example, the aforementioned prepolymer and a resin obtained through cross-link and/or chain elongation reaction of the prepolymer do not belong to the crystalline polyester resin C.

—Polyhydric Alcohol—

The polyhydric alcohol is appropriately selected depending on the intended purpose without any limitation, and examples thereof include diol, and trihydric or higher alcohol.

Examples of the diol include saturated aliphatic diol. Examples of the saturated aliphatic diol include linear chain saturated aliphatic diol, and branched-chain saturated aliphatic diol. Among them, linear chain saturated aliphatic diol is preferable, and C2-C12 linear chain saturated aliphatic diol is more preferable. When the saturated aliphatic diol has a branched-chain structure, crystallinity of the crystalline polyester resin C may be low, which may lower the melting point. When the number of carbon atoms in the saturated aliphatic diol is greater than 12, it may be difficult to yield a material in practice. The number of carbon atoms is therefore preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferable, as they give high crystallinity to a resulting crystalline polyester resin C, and give excellent sharp melt properties.

Examples of the trihydric or higher alcohol include glycerin, trimethylol ethane, trimethylol propane, and pentaerythritol.

These may be used independently, or in combination.

—Polyvalent Carboxylic Acid—

The polyvalent carboxylic acid is appropriately selected depending on the intended purpose without any limitation, and examples thereof include divalent carboxylic acid, and trivalent or higher carboxylic acid.

Examples of the divalent carboxylic acid include: saturated aliphatic dicarboxylic acid, such as oxalic acid, succinic acid, glutaric acid, adipic acid, suberic acid (octanedioic acid), azelaic acid, sebacic acid (decanedioic acid), 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid of dibasic acid, such as phthalic acid, isophthalic acid, terephthalic acid, naphthalene-2,6-dicarboxylic acid, malonic acid, and mesaconic acid; and anhydrides of the foregoing compounds, and lower (C1-C3) alkyl ester of the foregoing compounds.

Examples of the trivalent or higher carboxylic acid include 1,2,4-benzenetricarboxylic acid, 1,2,5-benzenetricarboxylic acid, 1,2,4-naphthalene tricarboxylic acid, anhydrides thereof, and lower (C1-C3) alkyl esters thereof.

Moreover, the polyvalent carboxylic acid may contain, other than the saturated aliphatic dicarboxylic acid or aromatic dicarboxylic acid, dicarboxylic acid containing a sulfonic acid group. Further, the polyvalent carboxylic acid may contain, other than the saturated aliphatic dicarboxylic acid or aromatic dicarboxylic acid, dicarboxylic acid having a double bond.

These may be used independently, or in combination.

The crystalline polyester resin C is preferably was composed of a C4-C12 linear chain saturated aliphatic dicarboxylic acid and a C2-C12 linear chain saturated aliphatic diol. Specifically, the crystalline polyester resin C preferably contains a constitutional unit derived from a C4-C12 saturated aliphatic dicarboxylic acid, and a constitutional unit derived from a C2-C12 saturated aliphatic diol. As a result of this, crystallinity increases, and sharp melt properties improve, and therefore it is preferable as excellent low temperature fixing ability of the toner is exhibited.

A melting point of the crystalline polyester resin C is appropriately selected depending on the intended purpose without any limitation, but it is preferably 60° C. to 80° C. When the melting point thereof is lower than 60° C., the crystalline polyester resin C tends to be melted at low temperature, which may impair heat resistant storage stability of the toner. When the melting point thereof is higher than 80° C., melting of the crystalline polyester resin C with heat applied during fixing may be insufficient, which may impair low temperature fixing ability of the toner.

A molecular weight of the crystalline polyester resin C is appropriately selected depending on the intended purpose without any limitation. Since those having a sharp molecular weight distribution and low molecular weight have excellent low temperature fixing ability, and heat resistant storage stability of a resulting toner lowers as an amount of a low molecular weight component, an o-dichlorobenzene soluble component of the crystalline polyester resin C preferably has the weight average molecular weight (Mw) of 3,000 to 30,000, number average molecular weight (Mn) of 1,000 to 10,000, and Mw/Mn of 1.0 to 10, as measured by GPC.

Further, it is more preferred that the weight average molecular weight (Mw) thereof be 5,000 to 15,000, the number average molecular weight (Mn) there be 2,000 to 10,000, and the Mw/Mn be 1.0 to 5.0.

An acid value of the crystalline polyester resin C is appropriately selected depending on the intended purpose without any limitation, but it is preferably 5 mgKOH/g or higher, more preferably 10 mgKOH/g or higher for achieving the desired low temperature fixing ability in view of affinity between paper and the resin. Meanwhile, the acid value thereof is preferably 45 mgKOH/g or lower for the purpose of improving hot offset resistance.

A hydroxyl value of the crystalline polyester resin C is appropriately selected depending on the intended purpose without any limitation, but it is preferably 0 mgKOH/g to 50 mgKOH/g, more preferably 5 mgKOH/g to 50 mgKOH/g, for achieving the desired low temperature fixing ability and excellent charging properties.

A molecular structure of the crystalline polyester resin C can be confirmed by solution-state or solid-state NMR, X-ray diffraction, GC/MS, LC/MS, or IR spectroscopy. Simple methods thereof include a method for detecting, as the crystalline polyester resin C, one that has absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the crystalline polyester resin C is appropriately selected depending on the intended purpose without any limitation, but it is preferably 3 parts by mass to 20 parts by mass, more preferably 5 parts by mass to 15 parts by mass, relative to 100 parts by mass of the toner. When the amount thereof is smaller than 3 parts by mass, the crystalline polyester resin C does not give sufficient sharp melt properties, which may lead to insufficient low temperature fixing ability of a resulting toner. When the amount thereof is greater than 20 parts by mass, a resulting toner may have low heat resistant storage stability, and tends to cause fogging of an image. When the amount thereof is within the aforementioned more preferable range, it is advantageous because a resulting toner is excellent in terms of both high image quality and low temperature fixing ability.

<Other Components>

Examples of other components include a releasing agent, colorant, charge controlling agent, external additive, a flow improving agent, a cleaning improving agent, and a magnetic material.

—Releasing Agent—

The releasing agent is appropriately selected from those known in the art without any limitation.

Examples of wax serving as the releasing agent include: natural wax, such as vegetable wax (e.g., carnauba wax, cotton wax, Japan wax and rice wax), animal wax (e.g., bees wax and lanolin), mineral wax (e.g., ozokelite and ceresine) and petroleum wax (e.g., paraffin wax, microcrystalline wax and petrolatum).

Examples of the wax other than the above natural wax include synthetic hydrocarbon wax (e.g., Fischer-Tropsch wax and polyethylene wax; and synthetic wax (e.g., ester wax, ketone wax and ether wax).

Further, other examples of the releasing agent include fatty acid amides such as 12-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, hydrocarbon wax, such as paraffin wax, microcrystalline wax, Fischer-Tropsch wax, polyethylene wax, and polypropylene wax, is preferable.

A melting point of the releasing agent is appropriately selected depending on the intended purpose without any limitation, but it is preferably 60° C. to 80° C. When the melting point thereof is lower than 60° C., the releasing agent tends to melt at low temperature, which may impair heat resistant storage stability. When the melting point thereof is higher than 80° C., the releasing agent is not sufficiently melted to thereby cause fixing offset even in the case where the resin is melted and is in the fixing temperature range, which may cause defects in an image.

An amount of the releasing agent is appropriately selected depending on the intended purpose without any limitation, but it is preferably 2 parts by mass to 10 parts by mass, more preferably 3 parts by mass to 8 parts by mass, relative to 100 parts by mass of the toner. When the amount thereof is smaller than 2 parts by mass, a resulting toner may have insufficient hot offset resistance, and low temperature fixing ability during fixing. When the amount thereof is greater than 10 parts by mass, a resulting toner may have insufficient heat resistant storage stability, and tends to cause fogging in an image. When the amount thereof is within the aforementioned more preferable range, it is advantageous because image quality and fixing stability can be improved.

—Colorant—

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is appropriately selected depending on the intended purpose without any limitation, but it is preferably 1 part by mass to 15 parts by mass, more preferably 3 parts by mass to 10 parts by mass, relative to 100 parts by mass of the toner.

The colorant may be used as a master batch in which the colorant forms a composite with a resin. Examples of the binder resin kneaded in the production of, or together with the master batch include, other than the aforementioned non-crystalline polyester resin B, polymer of styrene or substitution thereof (e.g., polystyrene, poly-p-chlorostyrene, and polyvinyl); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used independently, or in combination.

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

—Charge Controlling Agent—

The charge controlling agent is appropriately selected depending on the intended purpose without any limitation, and examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); LRA-901; boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

An amount of the charge controlling agent is appropriately selected depending on the intended purpose without any limitation, but it is preferably 0.1 parts by mass to 10 parts by mass, more preferably 0.2 parts by mass to 5 parts by mass, relative to 100 parts by mass of the toner. When the amount thereof is greater than 10 parts by mass, the charging ability of the toner becomes excessive, which may reduce the effect of the charge controlling agent, increase electrostatic force to a developing roller, leading to low flowability of the developer, or low image density of the resulting image. These charge controlling agents may be dissolved and dispersed after being melted and kneaded together with the master batch, and/or resin. The charge controlling agents can be, of course, directly added to an organic solvent when dissolution and dispersion is performed. Alternatively, the charge controlling agents may be fixed on surfaces of toner particles after the production of the toner particles.

—External Additive—

As for the external additive, other than oxide particles, a combination of inorganic particles and hydrophobic-treated inorganic particles can be used. The average primary particle diameter of the hydrophobic-treated particles is preferably 1 nm to 100 nm. More preferred are 5 nm to 70 nm of the inorganic particles.

Moreover, it is preferred that the external additive contain at least one type of hydrophobic-treated inorganic particles having the average primary particle diameter of 20 nm or smaller, and at least one type of inorganic particles having the average primary particle diameter of 30 nm or greater. Moreover, the external additive preferably has the BET specific surface area of 20 $m^2/g$ to 500 $m^2/g$.

The external additive is appropriately selected depending on the intended purpose without any limitation, and examples thereof include silica particles, hydrophobic silica, fatty acid metal salts (e.g., zinc stearate, and aluminum stearate), metal oxide (e.g., titania, alumina, tin oxide, and antimony oxide), and a fluoropolymer.

Examples of the suitable additive include hydrophobic silica, titania, titanium oxide, and alumina particles. Examples of the silica particles include R972, R974, RX200, RY200, R202, R805, and R812 (all manufactured by Nippon Aerosil Co., Ltd.). Examples of the titania particles include P-25 (manufactured by Nippon Aerosil Co., Ltd.); STT-30, STT-65C-S (both manufactured by Titan Kogyo, Ltd.); TAF-140 (manufactured by Fuji Titanium Industry Co., Ltd.); and MT-150W, MT-500B, MT-600B, MT-150A (all manufactured by TAYCA CORPORATION).

Examples of the hydrophobic treated titanium oxide particles include: T-805 (manufactured by Nippon Aerosil Co., Ltd.); STT-30A, STT-65S-S (both manufactured by Titan Kogyo, Ltd.); TAF-500T, TAF-1500T (both manufactured by Fuji Titanium Industry Co., Ltd.); MT-100S, MT-100T (both manufactured by TAYCA CORPORATION); and IT-S (manufactured by ISHIHARA SANGYO KAISHA, LTD.).

The hydrophobic-treated oxide particles, hydrophobic-treated silica particles, hydrophobic-treated titania particles, and hydrophobic-treated alumina particles are obtained, for example, by treating hydrophilic particles with a silane coupling agent, such as methyltrimethoxy silane, methyltriethoxy silane, and octyltrimethoxy silane. Moreover, silicone oil-treated oxide particles, or silicone oil-treated inorganic particles, which have been treated by adding silicone oil optionally with heat, are also suitably used as the external additive.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil. Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are preferable.

An amount of the external additive is appropriately selected depending on the intended purpose without any limitation, but it is preferably 0.1 parts by mass to 5 parts by mass, more preferably 0.3 parts by mass to 3 parts by mass, relative to 100 parts by mass of the toner.

The average particle diameter of primary particles of the inorganic particles is appropriately selected depending on the intended purpose without any limitation, but it is preferably 100 nm or smaller, more preferably 3 nm to 70 nm. When it is smaller than the aforementioned range, the inorganic particles are embedded in the toner particles, and therefore the function of the inorganic particles may not be effectively exhibited. When the average particle diameter thereof is greater than the aforementioned range, the inorganic particles may unevenly damage a surface of a photoconductor, and hence not preferable.

—Flow Improving Agent—

The flow improving agent is appropriately selected depending on the intended purpose without any limitation, provided that it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or titanium oxide be used as hydrophobic silica or hydrophobic titanium oxide treated with the aforementioned flow improving agent.

—Cleaning Improving Agent—

The cleaning improving agent is appropriately selected depending on the intended purpose without any limitation, provided that it can be added to the toner for the purpose of removing the developer remained on a photoconductor or primary transfer member after transferring. Examples thereof include: fatty acid metal salt such as zinc stearate, calcium stearate, and stearic acid; and polymer particles produced by soap-free emulsification polymerization, such as polymethyl methacrylate particles, and polystyrene particles. The polymer particles are preferably those having a relatively narrow particle size distribution, and the polymer particles having the volume average particle diameter of 0.01 μm to 1 μm are preferably used.

—Magnetic Material—

The magnetic material is appropriately selected depending on the intended purpose without any limitation, and examples thereof include iron powder, magnetite, and ferrite. Among them, a white magnetic material is preferable in terms of a color tone.

The toner preferably satisfies the relationships represented by the following formulae (1) and (2), where the SP value of the non-crystalline polyester resin A is determined as SP1, the SP value of the non-crystalline polyester resin B is determined as SP2, and the SP value of the crystalline polyester resin C is determined as SP3.

$$SP1-SP3>0.2 \quad \text{Formula (1)}$$

$$SP2-SP1>0.2 \quad \text{Formula (2)}$$

By setting the SP value of the non-crystalline polyester resin A to be smaller than the SP value of the non-crystalline polyester resin B by more than 0.2 (i.e. satisfying the formula (2)), a resulting toner can be provided with a micro phase separation structure where the non-crystalline polyester resin A is dispersed into the shapes of islands (also referred to as domains) each in the size of about a few hundreds nanometers in sea (also referred to as a continuous phase or matrix) of the non-crystalline polyester resin B. In the case where the toner has the aforementioned micro phase separation structure, the non-crystalline polyester resin A in the shape of islands is protected by the sea of the non-crystalline polyester resin in the condition where certain pressure is not applied, and therefore the non-crystalline polyester resin A does not flow out. Upon application of pressure and heat during fixing, however, the non-crystalline polyester resin A behaves as if it is compatible to the non-crystalline polyester resin B. Accordingly, the toner can be fixed at lower temperature than conventional fixing temperature.

As described above, it is possible to provide heat resistant storage stability and hot offset resistance to a toner by adding the non-crystalline polyester resin A having its glass transition temperature in an extremely low temperature region, which has high meltviscosity and hardly flows out, as a complex with the non-crystalline polyester resin B in the state of micro phase separation, even when the glass transition temperature of the toner is set low, and moreover, it is possible to attain low temperature fixing ability as well as the aforementioned favorable properties of the toner.

When the value of (SP2−SP1) is 0 to 0.2, the non-crystalline polyester resin A and the non-crystalline polyester resin B become uniformly compatible to each other, and therefore heat resistant storage stability of a toner may be low. When the toner satisfies SP2<SP1 (SP2−SP1<0), the non-crystalline polyester resin B tends to locate near a surface of a toner particle, and therefore heat resistant storage stability of a toner may be low.

The SP values of the non-crystalline polyester resin A and non-crystalline polyester resin B preferably satisfies the relationship represented by (SP2−SP1)>0.4, for giving a clear phase separation structure of the non-crystalline polyester resin A and non-crystalline polyester resin B, and improving low temperature fixing ability and heat resistant storage stability of a toner.

Moreover, a toner can attain heat resistant storage stability, and hot offset resistance, as the crystalline polyester resin C is present within the toner as crystal domains in the form of islands each in the size of a few hundreds nanometers, and moreover the toner can be provided with low temperature fixing ability, as well as the aforementioned favorable properties of the toner.

A difference between the SP value of the non-crystalline polyester resin A and the SP value of the crystalline polyester resin C is preferably a value satisfying the formula (1).

When the difference (SP1−SP3) between the SP value of the non-crystalline polyester resin A and the SP value of the crystalline polyester resin C is 0 to 0.2, the non-crystalline polyester resin A and the crystalline polyester resin C becomes uniformly compatible to each other, the non-crystalline polyester resin A and the crystalline polyester resin C tend to flow out at lower temperature, degrading heat resistant storage stability of a toner.

The difference between the SP value of the non-crystalline polyester resin A and the SP value of the crystalline polyester resin C is preferably greater than 0.4, i.e. (SP1−SP3)>0.4, because the non-crystalline polyester resin A and the crystalline polyester resin C have properties that they does not easily become compatible to each other and therefore low temperature fixing ability, and heat resistant storage stability of a toner are improved.

The micro phase separation structure can be confirmed by a toner particle is cut to expose a cross-section of the toner particle, dyeing the cross-section with heavy metal to give a contrast in color depending on how easily resins are dyed, and observing the dyed cross-section under a transmission electron microscope (TEM). Alternatively, the micro phase separation structure can be confirmed by observing the cross-section of the toner particle under an atomic force microscope (AFM) which can show a contrast depending on hardness of resins.

The toner preferably satisfies the relationships represented by the following formulae (3) and (4), where A is a phase of a probe when the non-crystalline polyester resin is measured by atomic force microscopy (AFM) in a tapping mode, B is a phase of a probe when the non-crystalline polyester resin B is measured by atomic force microscopy (AFM) in a tapping mode, and C is a phase of a probe when the non-crystalline polyester resin C is measured by atomic force microscopy (AFM) in a tapping mode.

$$A \geq C > B \quad \text{Formula (3)}$$

$$A - B \geq 5 \quad \text{Formula (4)}$$

Note that, a unit for the phase is "° (degree)."

In the tapping mode, a cantilever is an Si probe, resonance frequency is 300 kHz, and a spring constant is 42 N/m.

When the non-crystalline polyester resin A, the non-crystalline polyester resin B, and the crystalline polyester resin C are incompatible to each other within a toner particle at room temperature, a sea-island structure of a toner, where the non-crystalline polyester resin A is present in the shapes of islands in a sea of the non-crystalline polyester resin B, is formed. In such case, the phase A of the probe when the non-crystalline polyester resin A is measured by vibrating the probe under certain conditions in accordance with AFM of a tapping mode (conditions including a resonance frequency of 300 kHz, and spring constant of 42 N/m) is preferably larger than the phase B of the probe when the non-crystalline polyester resin B is measured in the same manner, i.e. (A>B). This relationship indicates that the non-crystalline polyester resin A is in a softer state than that of the non-crystalline polyester resin B. When these resins satisfies the aforementioned relationship, the non-crystalline polyester resin A in the shape of islands is protected by the sea of the non-crystalline polyester resin in the condition where certain pressure is not applied, and therefore the non-crystalline polyester resin A does not flow out. Upon application of pressure and heat during fixing, however, the non-crystalline polyester resin A behaves as if it is compatible to the non-crystalline polyester resin B. Accordingly, the toner can be fixed at lower temperature than conventional fixing temperature. Moreover, it is preferred that a difference in the phase satisfies the relationship represented by A−B≥5, for giving a clear sea-island structure of the non-crystalline polyester resin A and non-crystalline polyester resin B, and improving heat resistant storage stability of a toner.

As described above, it is possible to provide heat resistant storage stability and hot offset resistance to a toner by adding the non-crystalline polyester resin A having its glass transition temperature in an extremely low temperature region, which has high meltviscosity and hardly flows out, as a complex with the non-crystalline polyester resin B in the state of micro phase separation, even when the glass transition temperature of the toner is set low, and moreover, it is possible to attain low temperature fixing ability as well as the aforementioned favorable properties of the toner.

Moreover, a toner can attain heat resistant storage stability, and hot offset resistance, as the crystalline polyester resin C is present within the toner as crystal domains in the form of islands each in the size of a few hundreds nanometers, and moreover the toner can be provided with low temperature fixing ability, as well as the aforementioned favorable properties of the toner.

In an image of the toner taken by a transmission electron microscope (TEM), the non-crystalline polyester resin A and the crystalline polyester resin C are each present in the form of islands in a continuous phase (also referred to as a "matrix") of the non-crystalline polyester resin B. Here, the ratio of a sum of the area of the non-crystalline polyester resin A and the area of the crystalline polyester resin C occupying the total area of the toner in the TEM image, which is represented by [(area of non-crystalline polyester resin A+area of crystalline polyester resin C)/area of toner], is preferably 5% to 35%, more preferably 15% to 25%. When the aforementioned ratio is less than 5%, a proportion of the non-crystalline polyester resin A having extremely low glass transition temperature is small, and therefore a resulting toner does not easily deform at low temperature, as well as not easily deforming upon application of heat and pressure during fixing. As a result, the toner does not adhere to paper at low temperature, which may lead to poor low temperature fixing ability. Moreover, anti-filming properties of the toner may also be poor. When the ratio thereof is more than 35%, a resulting toner may have poor low temperature fixing ability. When the ratio thereof is within the aforementioned more preferable range, it is advantageous because a resulting toner is provided with all of excellent low temperature fixing ability, hot offset resistance, heat resistant storage stability, and anti-filming properties.

The toner has the glass transition temperature (Tg1st) of 20° C. to 40° C., as measured with the first heating in differential scanning calorimetry (DSC).

A conventional toner having Tg of about 50° C. or lower tends to occur aggregation of toner particle influenced by temperature variations during transporting or storage of the toner in summer or in a tropical region. As a result, the toner is solidified in a toner bottle, or within a developing unit. Moreover, supply failures due to clogging of the toner in the toner bottle, and formation of defected images due to toner deposition are likely to occur.

The toner of the present invention has lower Tg than that of a conventional toner. However, the non-crystalline polyester resin A, which is a low Tg component in the toner, has a non-linear chain structure, and therefore the toner of the present invention can maintain heat resistant storage stability. Especially in the case where the non-crystalline polyester resin A has a urethane bond or urea bond having high cohesive force, an effect of maintaining heat resistant storage stability becomes significant.

When Tg1st of the toner is lower than 20° C., the toner may have poor heat resistant storage stability, may cause blocking within a developing unit, and may cause filming on a photoconductor. When Tg1st thereof is higher than 40° C., the toner may have poor low temperature fixing ability.

A difference (Tg1st−Tg2nd) between the glass transition temperature (Tg1nd) of the toner as measured with the first heating in differential scanning calorimetry (DSC) and the glass transition temperature (Tg2nd) of the toner as measured with the second heating in DSC is appropriately selected depending on the intended purpose without any limitation, but it is preferably 10° C. or more. The upper limit of the difference is appropriately selected depending on the intended purpose without any limitation, but it is preferably 50° C. or less.

When the difference thereof is 10° C. or more, it is advantageous because the toner has excellent low temperature fixing ability. The difference thereof being 10° C. or more means that the crystalline polyester resin C, the non-crystalline polyester resin A and the non-crystalline polyester resin B, which are present in a non-compatible state before heating (before the first heating), become in a compatible state after heating (after the first heating). Note that, the compatible state after heating does not necessarily mean that these resins are in the state where they are completely compatible to each other.

Moreover, it is preferred that the difference (Tg1st−Tg2nd) between the glass transition temperature (Tg1st) of the toner as measured with the first heating in differential scanning calorimetry (DSC) and the glass transition temperature (Tg2nd) of the toner as measured with the second heating in DSC be 10° C. or more, and the melting point of the crystalline polyester resin C be 60° C. to 80° C.

A melting point of the toner is appropriately selected depending on the intended purpose without any limitation, but it is preferably 60° C. to 80° C.

The volume average particle diameter of the toner is appropriately selected depending on the intended purpose without any limitation, but it is preferably 3 μm to 7 μm. Moreover, a ratio of the volume average particle diameter to the number average particle diameter is preferably 1.2 or less. Further, the toner preferably contains toner particles having the volume average particle diameter of 2 μm or smaller, in an amount of 1% by number to 10% by number.

<Calculation Methods and Analysis Methods of Various Properties of Toner and Constitutional Component of Toner>

The SP value, Tg, acid value, hydroxyl value, molecular weight, and melting point of the non-crystalline polyester resin A, non-crystalline polyester resin B, crystalline polyester resin C, and releasing agent may be each measured per se. Alternatively, each component may be separated from an actual toner by gel permeation chromatography (GPC) or the like, and separated each component may be subjected to the analysis methods described later, to thereby calculate an SP value, Tg, molecular weight, melting point, and mass ratio of a constitutional component.

Separation of each component by GPC can be performed, for example, by the following method.

In GPC using tetrahydrofuran (THF) as a mobile phase, an eluate is subjected to fractionation by means of a fraction collector, a fraction corresponding to a part of a desired molecular weight is collected from a total area of an elution curve.

The collected eluates are concentrated and dried by an evaporator or the like, and a resulting solid content is dissolved in a deuterated solvent, such as deuterated chloroform, and deuterated THF, followed by measurement of $^{1}$H-NMR. From an integral ratio of each element, a ratio of a constitutional monomer of the resin in the elution composition is calculated.

As another method, after concentrating the eluate, hydrolysis is performed with sodium hydroxide or the like, and a ratio of a constitutional monomer is calculated by subjecting the decomposed product to a qualitative or quantitative analysis by high performance liquid chromatography (HPLC).

Note that, in the case where the method for producing a toner produces toner base particles by generating the non-crystalline polyester resin A through a chain-elongation reaction and/or crosslink reaction of the non-linear chain reactive precursor and the curing agent, the non-crystalline polyester resin A may be separated from an actual toner by GPC or the like, to thereby determine Tg thereof. Alternatively, a non-crystalline polyester resin A is separately generated through a chain-elongation reaction and/or crosslink reaction of the non-linear chain reactive precursor and the curing agent, and Tg may be measured on the synthesized non-crystalline polyester resin A.

<<Separation Unit for Toner Constitutional Components>>

An example of a separation unit for each component during an analysis of the toner will be specifically explained hereinafter.

First, 1 g of a toner is added to 100 mL THF, and the resulting mixture is stirred for 30 minutes at 25° C., to thereby a solution in which soluble components are dissolved.

The solution is then filtered through a membrane filter having an opening of 0.2 μm, to thereby obtain the THF soluble components in the toner.

Next, the THF soluble components are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS) is added as a standard material.

A glass tube for NMR having a diameter of 5 mm is charged with the solution, from which a spectrum is obtained by means of a nuclear magnetic resonance apparatus (JNM-AL 400, manufactured by JEOL Ltd.) by performing multiplication 128 times at temperature of 23° C. to 25° C.

The monomer compositions, and component ratios of the non-crystalline polyester resin A, the non-crystalline polyester resin B, and the crystalline polyester resin C contained in the toner are determined from peak integral ratios of the obtained spectrum.

For example, an assignment of a peak is performed in the following manner, and a constitutional monomer component ratio is determined from each integral ratio.

The assignment of a peak is as follows:

Around 8.25 ppm: derived from a benzene ring of trimellitic acid (for one hydrogen atom)

Around the region of 8.07 ppm to 8.10 ppm: derived from a benzene ring of terephthalic acid (for four hydrogen atoms)

Around the region of 7.1 ppm to 7.25 ppm: derived from a benzene ring of bisphenol A (for four hydrogen atoms)

Around 6.8 ppm: derived from a benzene ring of bisphenol A (for four hydrogen atoms), and derived from a double bond of fumaric acid (for two hydrogen atoms)

Around the region of 5.2 ppm to 5.4 ppm: derived from methine of bisphenol A propylene oxide adduct (for one hydrogen atom)

Around the region of 3.7 ppm to 4.7 ppm: derived from methylene of a bisphenol A propylene oxide adduct (for two hydrogen atoms), and derived from methylene of a bisphenol A ethylene oxide (for four hydrogen atoms)

Around 1.6 ppm: derived from a methyl group of bisphenol A (for 6 hydrogen atoms).

From these results, for example, the extracted product collected from the fraction in which the non-crystalline polyester resin A occupies 90% or more in the peak integral ratio in the spectrum can be treated as the non-crystalline polyester resin A. Similarly, the extracted product collected from the fraction in which the non-crystalline polyester resin B occupies 90% or more in the peak integral ratio in the spectrum can be treated as the non-crystalline polyester resin B. The extracted product collected from the fraction in which the non-crystalline polyester resin C occupies 90% or more in the peak integral ratio in the spectrum can be treated as the non-crystalline polyester resin C.

<<Phase of Probe in AFM of Tapping Mode>>

A method for observing a resin in atomic force microscopy (AFM) of a tapping mode, in other words, a phase of a probe when measuring the resin in AFM of a tapping mode, will be explained next.

The observation of the resin by the atomic force microscopy (AFM) of a tapping mode can be carried out by preparing an observation sample from a torn surface of the toner, and observing the torn surface. A method for preparing the observation sample is as follows.

Preparation Method of a Sample (1) After Ru block staining, the toner is embedded in the epoxy resin.

(2) The resin is sliced into a thin layer having a thickness of 10o nm by means of a microtome using ultrasonic.

(3) The thin layer is mounted on a silicon wafer.

Note that, when forming into a thin layer, it is sliced so that a cross section takes a substantially maximum area.

Subsequently, observation is performed in the following manner.

Observation Method

Analysis device: Intermolecular force probe microscopic system, manufactured by Asylum Technology Co., Ltd.

Cantilever: OMCL-AC160TS-C2

(Si probe, resonance frequency: 300 kHz (Typ.), spring constant: 42 N/m (Typ.))

Measuring mode: Tapping mode

Measuring conditions:

Target amplitude: 0.5 V

Target percent: −5%

Amplitude setpoint: 193 mV to 241 mV

Scan rate: 0.5 Hz

Scan points: 256×256

A measurement is performed with setting a scan range so as to include a whole part of one particle of the sample. In Examples of the present specification, an image of a phase is observed in the range of 10 μm×10 μm.

In the phase image, a part where the phase value is relatively high is a soft part.

<<SP value>>

The solubility parameter (SP) value will be explained.

The SP value is called a solubility parameter, and indicates, as a numerical value, the degree how each component is easily melted to one another. The SP value is represented by a square root of an attracting force between molecules, that is, cohesive energy density (CED). Note that, CED is a quantity of energy required for evaporating a material that is 1 mL in volume.

In the present invention, the SP value is calculated in accordance with a Fedors method using the following formula (I).

$$\text{SP value(solubility parameter)}=(CED\text{ value})^{1/2}=(E/V)^{1/2} \quad \text{Formula (I)}$$

In the formula (I), E is a molecular aggregation energy (cal/mol), and V is a molecular volume ($cm^3$/mol), which are each respectively represented by the following formulae (II), and (III):

$$E=\Sigma\Delta ei \quad \text{Formula (II)}$$

$$V=\Sigma\Delta vi \quad \text{Formula (III)}$$

In the formulae (II) and (III), Δei is evaporation energy of an atom group, and Δvi is molar volume.

In the calculation method above, as various data such as evaporation energy Δei of each atom group, and molar volume Δvi, the data described in "Basic Theory of Adhesion" (Minoru IMOTO, chapter 5, published by Highpolymer Publication (Kobunshi Kankokai)) is used.

Moreover, for the data not described in the aforementioned publication, such as that for —$CF_3$ group, R. F. Fedors, Polym. Eng. Sci. 14, 147 (1974) is referred.

Note that, for a reference purpose, when the SP value represented by the formula (I) is converted into an SI unit $(J/cm^3)^{1/2}$, the value of SP is multiplied by 2,046.

In the case where the non-crystalline polyester resin A, the non-crystalline polyester resin B, and the crystalline polyester resin C are each synthesized, and then mixed together, for example, the SP values of these resins are easily calculated in the aforementioned manner.

Generally, the resin whose resin skeleton is changed by adding a monomer in the course of polymerization is difficult to determine its SP value by calculation because of the composition ratios. Moreover, components contained in the toner are generally not known in terms of a composition thereof, and therefore calculation of the SP value thereof is difficult.

However, the calculation of the SP value in accordance with the Fedors method is possible, as long as types and ratios of monomers constituting resins are determined.

For example, the SP value of a mixture of the non-crystalline polyester resin A, the non-crystalline polyester resin B, and the crystalline polyester resin C can be calculated by separating by GPC, and measuring each separated component in the aforementioned analysis method.

The calculation of the SP value in accordance with the Fedors method is possible, if types and ratios of the monomers constituting the resin are determined. In the case where the monomer type is determined by the aforementioned analysis, the SP value used in the present invention is calculated from a monomer composition whose a total of component ratios of components reach 90 mol %, when a component ratio of each component is added from the component having the higher ratio (specifically, the remained monomer are not added for the calculation of the SP value).

<<Measurement Methods of Hydroxyl Value and Acid Value>>

The hydroxyl value can be measured by the method according to JIS K0070-1966.

Specifically, 0.5 g of a sample is measured in a 100 mL measuring flask, and to this 5 mL of an acetylation reagent. Next, the mixture is heated for 1 hour to 2 hours in a hot water bath of 100° C.±5° C., and then the flask is taken out from the hot water bath and left to cool. Next, to the resultant, water is added, and the resulting mixture is shaken to decompose acetic anhydride. In order to completely decompose acetic anhydride, the flask is again heated for 10 minutes or longer in a hot water bath and left to cool, followed by sufficiently washing a wall of the flask with an organic solvent.

Further, the hydroxyl value is measured at 23° C. by means of a potentiometric automatic titrator (DL-53 Titrator, manufactured by Mettler-Toledo K.K.) and an electrode DG113-SC (product of Mettler-Toledo K.K.). The measurements are analyzed with an analysis software LabX Light Version 1.00.000. Note that, a mixed solvent of 120 mL of toluene and 30 mL of ethanol is used for calibration of the device.

The measuring conditions are as follows.

[Conditions of Measurement]

Stir
- Speed [%] 25
- Time [s] 15

EQP Titration
- Titrant/Sensor
  - Titrant $CH_3ONa$
  - Concentration [mol/L] 0.1
  - Sensor DG115
  - Unit of measurement mV
- Predispensing to Volume
  - Volume [mL] 1.0
  - Wait time [s] 0
- Titrant Addition Dynamic
  - dE (set) [mV] 8.0
  - dV (min) [mL] 0.03
  - dV (max) [mL] 0.5
- Measure Mode Equilibrium Controlled
  - dE [mV] 0.5
  - dt [s] 1.0
  - t (min) [s] 2.0
  - t (max) [s] 20.0
- Recognition
  - Threshold 100.0
  - Steepest jump only No
  - Range No
  - Tendency None
- Termination
  - at maximum volume [mL] 10.0
  - at potential No
  - at slope No
  - after number EQPs Yes
    - n=1
  - comb. termination conditions No
- Evaluation
  - Procedure Standard
  - Potential 1 No
  - Potential 2 No
  - Stop for reevaluation No The acid value can be measured by the method according to JIS K0070-1992.

Specifically, 0.5 g of sample (soluble matter in ethyl acetate: 0.3 g) is added to 120 mL of toluene, and the resultant mixture is stirred for about 10 hours at 23° C. for dissolution. Next, ethanol (30 mL) is added thereto to prepare a sample solution. Notably, when the sample is not dissolved in toluene, another solvent such as dioxane or tetrahydrofuran is used. Then, a potentiometric automatic titrator (DL-53 Titrator, manufactured by Mettler-Toledo K.K.) and an electrode DG113-SC (product of Mettler-Toledo K.K.) are used to measure the acid value at 23° C. The measurements are analyzed with analysis software LabX Light Version 1.00.000. Note that, a mixed solvent of 120 mL of toluene and 30 mL of ethanol is used for calibration of the device.

The measuring conditions are the same as in the conditions for the measurement of hydroxyl value as described above.

The acid value can be measured in the above-described manner. Specifically, the sample solution is titrated with a pre-standardized 0.1N potassium hydroxide/alcohol solution and then the acid value is calculated from the titer using the equation: acid value (KOHmg/g)=titer (mL)×N×56.1 (mg/mL)/mass of sample (g), where N is a factor of 0.1N potassium hydroxide/alcohol solution.

<<Measurement Methods of Melting Point and Glass Transition Temperature (Tg)>>

In the present invention, a melting point and glass transition temperature (Tg) can be measured, for example, by means of a differential scanning calorimeter (DSC) system (Q-200, manufactured by TA Instruments Japan Inc.).

Specifically, a melting point and glass transition temperature of a sample are measured in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by means of a differential scanning calorimeter (Q-200, manufactured by TA Instruments Japan Inc.).

The DSC curve for the first heating is selected from the obtained DSC curve by means of an analysis program stored in the Q-200 system, to thereby determine glass transition temperature of the sample with the first heating. Similarly, the DSC curve for the second heating is selected, and the glass transition temperature of the sample with the second heating can be determined.

Moreover, the DSC curve for the first heating is selected from the obtained DSC curve by means of the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

In the case where a toner is used as a sample, glass transition temperature for the first heating is represented as Tg1st, and glass transition temperature for the second heating is represented as Tg2nd in the present specification.

Moreover, in the present specification, the endothermic peak top temperatures and glass transition temperatures of the non-crystalline polyester resin A, non-crystalline polyester resin B, and crystalline polyester resin C, and other constitutional components, such as the releasing agent, for the second heating are regarded as melting point and Tg of each sample, unless otherwise stated.

<<Method for Measuring Particle Size Distribution>>

The volume average particle diameter ($D_4$) and number average particle diameter ($D_n$) of the toner and the ratio thereof ($D_4/D_n$) can be measured, for example, by means of Coulter Counter TA-II or Coulter Multisizer II (both manufactured by Beckman Coulter, Inc.). In the present invention, Coulter Multisizer II is used. The measurement method will be explained below.

First, 0.1 mL to 5 mL of a surfactant (preferably alkyl benzene sulfonate (nonionic surfactant)) was added as a dispersant to 100 mL to 150 mL of an electrolyte. Note that, the electrolyte is an about 1% by mass aqueous solution prepared by using a primary sodium chloride, and for example, ISOTON-II (of Beckman Coulter, Inc.) is used as the electrolyte. Next, to the resulting mixture, 2 mg to 20 mg of a sample is added and suspended, and the mixture is dispersed by means of an ultrasonic wave disperser for about 1 minute to about 3 minutes. The volume and number of the toner particles or toner are measured from the obtained dispersion liquid using the aforementioned measuring device with an aperture of 100 μm, and then the volume distribution and number distribution of the toner are calculated. From the obtained distributions, the volume average particle diameter ($D_4$), and number average particle diameter ($D_n$) of the toner can be determined.

Note that, as a channel, the following 13 channels are used: 2.00 μm or larger, but smaller than 2.52 μm; 2.52 μm or larger, but smaller than 3.17 μm; 3.17 μm or larger, but smaller than 4.00 μm; 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm; and 32.00 μm or larger, but smaller than 40.30 μm. The target particles for the measurement are particles having the diameters of 2.00 μm or larger, but smaller than 40.30 μm.

<<Measurement of Molecular Weight>>

A molecular weight of each constitutional component of a toner can be measured, for example, by the following method.

Gel permeation chromatography (GPC) measuring device: GPC-8220GPC (manufactured by TOSOH CORPORATION)

Column: TSKgel SuperHZM-H 15 cm, three connected columns (manufactured by TOSOH CORPORATION)

Temperature: 40° C.

Solvent: THF

Flow rate: 0.35 mL/min

Sample: 0.4 mL of a 0.15% by mass sample to be supplied

As for the pretreatment of the sample, the sample is dissolved in tetrahydrofuran (THF) (containing a stabilizer, manufactured by Wako Chemical Industries, Ltd.) to give a concentration of 0.15% by mass, the resulting solution is then filtered through a filter having a pore size of 0.2 μm, and the filtrate from the filtration is used as a sample. The measurement is performed by supplying 100 μL of the tetrahydrofuran (THF) sample solution. For the measurement of the molecular weight of the sample, a molecular weight distribution of the sample is calculated from the relationship between the logarithmic value of the calibration curve prepared from a several monodispersible polystyrene standard samples and the number of counts. As the standard polystyrene samples for preparing the calibration curve, Showdex STANDARD Std. Nos. S-7300, S-210, S-390, S-875, S-1980, S-10.9, S-629, S-3.0, and S-0.580 of SHOWA DENKO K.K., and toluene are used. As the detector, a refractive index (R1) detector is used.

<Production Method of Toner>

A production method of the toner is appropriately selected depending on the intended purpose without any limitation, but the toner is preferably granulated by dispersing, in an aqueous medium, an oil phase containing the non-crystalline polyester resin A, the non-crystalline polyester resin B, and the crystalline polyester resin C, optionally containing the releasing agent, and the colorant.

Moreover, the toner is preferably granulated by dispersing, in an aqueous medium, an oil phase containing the non-linear chain reactive precursor, the non-crystalline polyester resin B, and the crystalline polyester resin C, and optionally containing the curing agent, the releasing agent, and the colorant.

As one example of such a production method of the toner, a conventionally dissolution suspension method is listed.

As one example of the production method of the toner, a method for forming toner base particles while generating the non-crystalline polyester resin A through a chain-elongation reaction and/or cross-link reaction between the non-linear chain reactive precursor and the curing agent will be described hereinafter. In such a method, a preparation of an aqueous medium, preparation of an oil phase containing a toner material, emulsification and/or dispersion of the toner material, and removal of an organic solvent are carried out.

—Preparation of Aqueous Medium (Aqueous Phase)—

The preparation of the aqueous phase can be carried out, for example, by dispersing resin particles in an aqueous medium. An amount of the resin particles in the aqueous medium is appropriately selected depending on the intended purpose without any limitation, but it is preferably 0.5 parts by mass to 10 parts by mass relative to 100 parts by mass of the aqueous medium.

The aqueous medium is appropriately selected depending on the intended purpose without any limitation, and examples thereof include water, a solvent miscible with water, and a mixture thereof. These may be used independently, or in combination.

Among them, water is preferable.

The solvent miscible with water is appropriately selected depending on the intended purpose without any limitation, and examples thereof include alcohol, dimethyl formamide, tetrahydrofuran, cellosolve, and lower ketone. The alcohol is appropriately selected depending on the intended purpose without any limitation, and examples thereof include methanol, isopropanol, and ethylene glycol. The lower ketone is appropriately selected depending on the intended purpose without any limitation, and examples thereof include acetone, and methyl ethyl ketone.

—Preparation of Oil Phase—

The preparation of an oil phase containing a toner material can be carried out by dissolving and/or dispersing, in an organic solvent, a toner material containing at least the non-linear chain reactive precursor, the non-crystalline polyester resin B, and the crystalline polyester resin C, and optionally containing the curing agent, the releasing agent, and the colorant.

The organic solvent is appropriately selected depending on the intended purpose without any limitation, but it is preferably an organic solvent having a boiling point of lower than 150° C., as removal thereof is easy.

The organic solvent having the boiling point of lower than 150° C. is appropriately selected depending on the intended purpose without any limitation, and examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used independently, or in combination.

Among them, ethyl acetate, toluene, xylene, benzene, methylene chloride, 1,2-dichloroethane, chloroform, and carbon tetrachloride are particularly preferable, and ethyl acetate is more preferable.

—Emulsification and/or Dispersion—

The emulsification and/or dispersion of the toner material can be carried out by dispersing the oil phase containing the toner material in the aqueous medium. In the course of the emulsification and/or dispersion of the toner material, the curing agent and the non-linear chain reactive precursor are allowed to carry out a chain-elongation reaction and/or cross-link reaction, to thereby generate the non-crystalline polyester resin A.

The non-crystalline polyester resin A can be generated, for example, by the following methods (1) to (3).

(1) A method for generating the non-crystalline polyester resin A by emulsifying or dispersing, in an aqueous medium, an oil phase containing the non-linear chain reactive precursor and the curing agent, to allow the curing agent and the non-linear chain reactive precursor to carry out a chain-elongation reaction and/or cross-link reaction in the aqueous medium.

(2) A method for generating the non-crystalline polyester resin A by emulsifying or dispersing, in an aqueous medium to which the curing agent has been added in advance, an oil phase containing the non-linear chain reactive precursor, to thereby allow the curing agent and the non-linear chain reactive precursor to carry out a chain-elongation reaction and/or cross-link reaction in the aqueous medium.

(3) A method for generating the non-crystalline polyester resin A by emulsifying or dispersing, in an aqueous medium, an oil phase containing the non-linear chain reactive precursor, followed by adding the curing agent to the aqueous medium, to thereby initiate a chain-elongation reaction and/or cross-link reaction of the curing agent and the non-linear chain reactive precursor from each interface of particles in the aqueous medium.

In the case where the chain-elongation reaction and/or cross-link reaction of the curing agent and the non-linear chain reactive precursor are initiated from each interface of particles, the non-crystalline polyester resin A is formed preferentially to a surface of a generated toner particle, so that a concentration gradient of the non-crystalline polyester resin A can be provided within the toner particle.

The reaction conditions (e.g., the reaction time and reaction temperature) for generating the non-crystalline polyester resin A are appropriately selected depending on a combination of the curing agent and the non-linear chain reactive precursor without any limitation.

The reaction time is appropriately selected depending on the intended purpose without any limitation, but it is preferably 10 minutes to 40 hours, more preferably 2 hours to 24 hours.

The reaction temperature is appropriately selected depending on the intended purpose without any limitation, but it is preferably 0° C. to 150° C., more preferably 40° C. to 98° C.

A method for stably forming a dispersion liquid containing the non-linear chain reactive precursor in the aqueous medium is appropriately selected depending on the intended purpose without any limitation, and examples thereof include a method in which an oil phase, which has been prepared by dissolving and/or dispersing a toner material in a solvent, is added to a phase of an aqueous medium, followed by dispersing with shear force.

A disperser used for the dispersing is appropriately selected depending on the intended purpose without any limitation, and examples thereof include a low-speed shearing disperser, a high-speed shearing disperser, a friction disperser, a high-pressure jetting disperser and an ultrasonic wave disperser.

Among them, the high-speed shearing disperser is preferable, because it can control the particle diameters of the dispersed elements (oil droplets) to the range of 2 μm to 20 μm.

In the case where the high-speed shearing disperser is used, the conditions for dispersing, such as the rotating speed, dispersion time, and dispersion temperature, are appropriately selected depending on the intended purpose.

The rotational speed is appropriately selected depending on the intended purpose without any limitation, but it is preferably 1,000 rpm to 30,000 rpm, more preferably 5,000 rpm to 20,000 rpm.

The dispersion time is appropriately selected depending on the intended purpose without any limitation, but it is preferably 0.1 minutes to 5 minutes in case of a batch system.

The dispersion temperature is appropriately selected depending on the intended purpose without any limitation, but it is preferably 0° C. to 150° C., more preferably 40° C. to 98° C. under pressure. Note that, generally speaking, dispersion can be easily carried out, as the dispersion temperature is higher.

An amount of the aqueous medium used for the emulsification and/or dispersion of the toner material is appropriately selected depending on the intended purpose without any limitation, but it is preferably 50 parts by mass to 2,000 parts by mass, more preferably 100 parts by mass to 1,000 parts by mass, relative to 100 parts by mass of the toner material.

When the amount of the aqueous medium is smaller than 50 parts by mass, the dispersion state of the toner material is impaired, which may result a failure in attaining toner base particles having desired particle diameters. When the amount thereof is greater than 2,000 parts by mass, the production cost may increase.

When the oil phase containing the toner material is emulsified and/or dispersed, a dispersant is preferably used for the purpose of stabilizing dispersed elements, such as oil droplets, and gives a shape particle size distribution as well as giving desirable shapes of toner particles.

The dispersant is appropriately selected depending on the intended purpose without any limitation, and examples thereof include a surfactant, a water-insoluble inorganic compound dispersant, and a polymer protective colloid. These may be used independently, or in combination.

Among them, the surfactant is preferable.

The surfactant is appropriately selected depending on the intended purpose without any limitation, and examples thereof include an anionic surfactant, a cationic surfactant, a nonionic surfactant, and an amphoteric surfactant.

The anionic surfactant is appropriately selected depending on the intended purpose without any limitation, and examples thereof include alkyl benzene sulfonic acid salts, α-olefin sulfonic acid salts and phosphoric acid esters.

Among them, those having a fluoroalkyl group are preferable.

A catalyst can be used for the chain-elongation reaction and/or cross-link reaction for generating the non-crystalline polyester resin A.

The catalyst is appropriately selected depending on the intended purpose without any limitation, and examples thereof include dibutyl tin laurate, and dioctyl tin laurate.

—Removal of Organic Solvent—

A method for removing the organic solvent from the dispersion liquid such as the emulsified slurry is appropriately selected depending on the intended purpose without any limitation, and examples thereof include: a method in which an entire reaction system is gradually heated to evaporate out the organic solvent in the oil droplets; and a method in which the dispersion liquid is sprayed in a dry atmosphere to remove the organic solvent in the oil droplets.

As the organic solvent removed, toner base particles are formed. The toner base particles can be subjected to washing and drying, and can be further subjected to classification. The classification may be carried out in a liquid by removing small particles by cyclone, a decanter, or centrifugal separator, or may be performed on particles after drying.

The obtained toner base particles may be mixed with particles such as the external additive, and the charge controlling agent. By applying a mechanical impact during the mixing, the particles such as the external additive can be prevented from fall off from surfaces of the toner base particles.

A method for applying the mechanical impact is appropriately selected depending on the intended purpose without any limitation, and examples thereof include: a method for applying impulse force to a mixture by a blade rotating at high speed; a method for adding a mixture into a high-speed air flow and accelerating the speed of the flow to thereby make the particles crash into other particles, or make the composite particles crush into an appropriate impact board.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Developer)

The developer of the present invention contains at least the toner, and may further contain appropriately selected other components, such as carrier, if necessary.

Accordingly, the developer has excellent transfer properties, and charging ability, and can stably form high quality images. Note that, the developer may be a one-component developer, or two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is balanced, namely, the toner is supplied to the developer, and consumed by developing, the toner does not cause filming to a developing roller, nor fuse to a layer thickness regulating member such as a blade for thinning a thickness of a layer of the toner, and provides excellent and stable developing ability and image even when it is stirred in the developing unit over a long period of time.

In the case where the developer is used as a two-component developer, the diameters of the toner particles in the developer do not vary largely even when the toner is balanced, and the toner can provide excellent and stabile developing ability even when the toner is stirred in the developing unit over a long period of time.

<Carrier>

The carrier is appropriately selected depending on the intended purpose without any limitation, but it is preferably a carrier containing a core, and a resin layer covering the core.

—Core—

A material of the core is appropriately selected depending on the intended purpose without any limitation, and examples thereof include a 50 emu/g to 90 emu/g manganese-strontium (Mn—Sr) material, and a 50 emu/g to 90 emu/g manganese-magnesium (Mn—Mg) material. To secure a sufficient image density, use of a hard magnetic material such as iron powder (100 emu/g or higher), and magnetite (75 emu/g to 120 emu/g) is preferable. Moreover, use of a soft magnetic material such as a 30 emu/g to 80 emu/g copper-zinc material is preferable because an impact applied to a photoconductor by the developer born on a bearing member in the form of a brush can be reduced, which is an advantageous for improving image quality.

These may be used independently, or in combination.

The volume average particle diameter of the core is appropriately selected depending on the intended purpose without any limitation, but it is preferably 10 μm to 150 μm, more preferably 40 μm to 100 μm. When the volume average particle diameter thereof is smaller than 10 μm, the proportion of fine particles in the distribution of carrier particle diameters increases, causing carrier scattering because of low magnetization per carrier particle. When the volume average particle diameter thereof is greater than 150 μm, the specific surface area reduces, which may cause toner scattering, causing reproducibility especially in a solid image portion in a full color printing containing many solid image portions.

In the case where the toner is used for a two-component developer, the toner is used by mixing with the carrier. An amount of the carrier in the two-component developer is appropriately selected depending on the intended purpose without any limitation, but it is preferably 90 parts by mass to 98 parts by mass, more preferably 93 parts by mass to 97 parts by mass, relative to 100 parts by mass of the two-component developer.

EXAMPLES

Examples of the present invention will be explained hereinafter, but these examples shall not be construed as to limit the scope of the present invention in any way. Note that, in the following description, "part(s)" denotes "part(s) by mass", and "%" denotes "% by mass," unless otherwise stated.

Each measurement value depicted in the following examples was measured by the methods described in the present specification. Note that, the SP values, Tg, and molecular weights of the non-crystalline polyester resin A, the non-crystalline polyester resin B, the crystalline polyester resin C and the like were measured from each resin obtained in Production Example.

Production Example 1

<Synthesis of Ketimine>

A reaction vessel equipped with a stirring bar and a thermometer was charged with 170 parts of isophorone diamine and 75 parts of methyl ethyl ketone, and the resulting mixture was allowed to react for 5 hours at 50° C., to thereby obtain Ketimine Compound I. Ketimine Compound I had the amine value of 418.

Production Example A-1

<Synthesis of Non-Crystalline Polyester Resin A-1>

—Synthesis of Prepolymer A-1—

A reaction vessel equipped with a condenser, a stirrer and a nitrogen-introducing pipe was charged with 3-methyl-1,5-pentanediol, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 40 mol % of isophthalic acid, and 60 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-1.

Next, a reaction vessel equipped with a condenser, a stirrer and a nitrogen-introducing pipe was charged with Intermediate Polyester A-1, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-1.

—Synthesis of Non-Crystalline Polyester Resin A-1—

Prepolymer A-1 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-1. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-1. Physical properties of Non-Crystalline Polyester Resin A-1 are depicted in Tables 1-1 to 1-2, and 1-4.

Production Example A-2

<Synthesis of Non-Crystalline Polyester Resin A-2>

—Synthesis of Prepolymer A-2—

A reaction vessel equipped with a condenser, a stirrer and a nitrogen-introducing pipe was charged with 1,6-hexanediol, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 1,6-hexanediol, the dicarboxylic acid component was composed of 80 mol % of isophthalic acid and 20 mol % of adipic acid, and an amount of trimellitic anhydride was 1 mol % relative to a total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-2.

Next, a reaction vessel equipped with a condenser, a stirrer and a nitrogen-introducing pipe was charged with Intermediate Polyester A-2, and isophorone diisocyanate at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-2.

—Synthesis of Non-Crystalline Polyester Resin A-2—

Prepolymer A-2 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-2. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-2. Physical properties of Non-Crystalline Polyester Resin A-2 are depicted in Table 1-1.

Production Example A-3

<Synthesis of Non-Crystalline Polyester Resin A-3>

—Synthesis of Prepolymer A-3—

A reaction vessel equipped with a condenser, a stirrer and a nitrogen-introducing pipe was charged with 3-methyl-1,5-pentanediol, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid was composed of 100 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-3.

Next, a reaction vessel equipped with a condenser, a stirrer and a nitrogen-introducing pipe was charged with Intermediate Polyester A-3, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-3.

—Synthesis of Non-Crystalline Polyester Resin A-3—

Prepolymer A-3 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-3. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-3. Physical properties of Non-Crystalline Polyester Resin A-3 are depicted in Table 1-1.

Production Example A-4

<Synthesis of Non-Crystalline Polyester Resin A-4>

—Synthesis of Prepolymer A-4—

A reaction vessel equipped with a condenser, a stirrer and a nitrogen-introducing pipe was charged with 3-methyl-1,5-pentanediol, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 28 mol % of isophthalic acid and 72 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-4.

Next, a reaction vessel equipped with a condenser, a stirrer and a nitrogen-introducing pipe was charged with Intermediate Polyester A-4, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-4.

—Synthesis of Non-Crystalline Polyester Resin A-4—

Prepolymer A-4 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-4. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-4. Physical properties of Non-Crystalline Polyester Resin A-4 are depicted in Tables 1-3 to 1-5.

Production Example A-5

<Synthesis of Non-Crystalline Polyester Resin A-5>

—Synthesis of Prepolymer A-5—

A reaction vessel equipped with a condenser, a stirrer and a nitrogen-introducing pipe was charged with 3-methyl-1,5-pentanediol, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 22 mol % and 78 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-5.

Next, a reaction vessel equipped with a condenser, a stirrer and a nitrogen-introducing pipe was charged with Intermediate Polyester A-5, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-5.

—Synthesis of Non-Crystalline Polyester Resin A-5—

Prepolymer A-5 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-5. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-5. Physical properties of Non-Crystalline Polyester Resin A-5 are depicted in Table 1-3.

Production Example A-6

<Synthesis of Non-Crystalline Polyester Resin A-6>

—Synthesis of Prepolymer A-6—

A reaction vessel equipped with a condenser, a stirrer and a nitrogen-introducing pipe was charged with 3-methyl-1,5-pentanediol, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 55 mol % of isophthalic acid and 45 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-6.

Next, a reaction vessel equipped with a condenser, a stirrer and a nitrogen-introducing pipe was charged with Intermediate Polyester A-6, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-6.

—Synthesis of Non-Crystalline Polyester Resin A-6—

Prepolymer A-6 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-6. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-6. Physical properties of Non-Crystalline Polyester Resin A-6 are depicted in Table 1-3.

Production Example A-7

<Synthesis of Non-Crystalline Polyester Resin A-7>

—Synthesis of Prepolymer A-7—

A reaction vessel equipped with a condenser, a stirrer and a nitrogen-introducing pipe was charged with 3-methyl-1,5-pentanediol, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 60 mol % of isophthalic acid and 40 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-7.

Next, a reaction vessel equipped with a condenser, a stirrer and a nitrogen-introducing pipe was charged with Intermediate Polyester A-7, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-7.

—Synthesis of Non-Crystalline Polyester Resin A-7—

Prepolymer A-7 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-7. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-7. Physical properties of Non-Crystalline Polyester Resin A-7 are depicted in Table 1-4.

Production Example A-8

<Synthesis of Non-Crystalline Polyester Resin A-8>

—Synthesis of Prepolymer A-8—

A reaction vessel equipped with a condenser, a stirrer and a nitrogen-introducing pipe was charged with 3-methyl-1,5-pentanediol, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 25 mol % of isophthalic acid and 75 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-8.

Next, a reaction vessel equipped with a condenser, a stirrer and a nitrogen-introducing pipe was charged with Intermediate Polyester A-8, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-8.

—Synthesis of Non-Crystalline Polyester Resin A-8—

Prepolymer A-8 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-8. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-8. Physical properties of Non-Crystalline Polyester Resin A-8 are depicted in Table 1-4.

Production Example A-9

<Synthesis of Non-Crystalline Polyester Resin A-9>

—Synthesis of Prepolymer A-9—

A reaction vessel equipped with a condenser, a stirrer and a nitrogen-introducing pipe was charged with 3-methyl-1,5-pentanediol, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 52 mol % of isophthalic acid and 48 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-9.

Next, a reaction vessel equipped with a condenser, a stirrer and a nitrogen-introducing pipe was charged with Intermediate Polyester A-9, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-9.

—Synthesis of Non-Crystalline Polyester Resin A-9—

Prepolymer A-9 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-9. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-9. Physical properties of Non-Crystalline Polyester Resin A-9 are depicted in Table 1-4.

Production Example A-10)

<Synthesis of Non-Crystalline Polyester Resin A-10>

—Synthesis of Prepolymer A-10—

A reaction vessel equipped with a condenser, a stirrer and a nitrogen-introducing pipe was charged with 3-methyl-1,5-pentanediol, bisphenol A ethylene oxide 2 mol adduct, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 55 mol % of 3-methyl-1,5-pentanediol and 45 mol % of bisphenol A ethylene oxide 2 mol adduct, the dicarboxylic acid component was composed of 40 mol % of isophthalic acid and 60 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-10.

Next, a reaction vessel equipped with a condenser, a stirrer and a nitrogen-introducing pipe was charged with Intermediate Polyester A-10, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-10.

—Synthesis of Non-Crystalline Polyester Resin A-10—

Prepolymer A-10 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-10. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-10. Physical properties of Non-Crystalline Polyester Resin A-10 are depicted in Table 1-5.

Production Example A-11)

<Synthesis of Non-Crystalline Polyester Resin A-11>

—Synthesis of Prepolymer A-11—

A reaction vessel equipped with a condenser, a stirrer and a nitrogen-introducing pipe was charged with 3-methyl-1,5-pentanediol, bisphenol A ethylene oxide 2 mol adduct, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 45 mol % of 3-methyl-1,5-pentanediol and 55 mol % of bisphenol A ethylene oxide 2 mol adduct, the dicarboxylic acid component was composed of 40 mol % of isophthalic acid and 60 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A-11.

Next, a reaction vessel equipped with a condenser, a stirrer and a nitrogen-introducing pipe was charged with Intermediate Polyester A-11, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A-11.

—Synthesis of Non-Crystalline Polyester Resin A-11—

Prepolymer A-11 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A-11. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A-11. Physical properties of Non-Crystalline Polyester Resin A-11 are depicted in Table 1-5.

Production Example A'-1

<Synthesis of Non-Crystalline Polyester Resin A'-1>

—Synthesis of Prepolymer A'-1—

A reaction vessel equipped with equipped with a condenser, a stirrer and a nitrogen-introducing pipe was charged with 3-methyl-1,5-pentanediol, isophthalic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 100 mol % of isophthalic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A'-1.

Next, a reaction vessel equipped with a condenser, a stirrer and a nitrogen-introducing pipe was charged with Intermediate Polyester A'-1, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A'-1.

—Synthesis of Non-Crystalline Polyester Resin A'-1—

Prepolymer A'-1 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A'-1. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin N-1. Physical properties of Non-Crystalline Polyester Resin A'-1 are depicted in Table 1-2.

Production Example A'-2

<Synthesis of Non-Crystalline Polyester Resin A'-2>

—Synthesis of Prepolymer A'-2—

A reaction vessel equipped with a condenser, a stirrer and a nitrogen-introducing pipe was charged with 3-methyl-1,5-pentanediol, decanedioic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 100 mol % of decanedioic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A'-2.

Next, a reaction vessel equipped with a condenser, a stirrer and a nitrogen-introducing pipe was charged with Intermediate Polyester A'-2, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A'-2.

—Synthesis of Non-Crystalline Polyester Resin A'-2—

Prepolymer A'-2 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A'-2. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A'-2. Physical properties of Non-Crystalline Polyester Resin A'-2 are depicted in Table 1-2.

Production Example A'-3

<Synthesis of Non-Crystalline Polyester Resin A'-3>

—Synthesis of Prepolymer A'-3—

A reaction vessel equipped with a condenser, a stirrer and a nitrogen-introducing pipe was charged with 3-methyl-1,5-pentanediol, bisphenol A ethylene oxide 2 mol adduct, isophthalic acid, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 20 mol % of 3-methyl-1,5-pentanediol and 80 mol % of bisphenol A ethylene oxide 2 mol adduct, the dicarboxylic acid component was composed of 50 mol % of isophthalic acid and 50 mol % of adipic acid, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A'-3.

Next, a reaction vessel equipped with a condenser, a stirrer and a nitrogen-introducing pipe was charged with Intermediate Polyester A'-3, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A'-3.

—Synthesis of Non-Crystalline Polyester Resin A'-3—

Prepolymer A'-3 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A'-3. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A'-3. Physical properties of Non-Crystalline Polyester Resin A'-3 are depicted in Table 1-5.

Production Example A'-4

<Synthesis of Non-Crystalline Polyester Resin A'-4>

—Synthesis of Prepolymer A'-4—

A reaction vessel equipped with a condenser, a stirrer and a nitrogen-introducing pipe was charged with 3-methyl-1,5-pentanediol, adipic acid, and trimellitic anhydride, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 100 mol % of adipic acid, and an amount of trimellitic anhydride was 1 mol % relative to the total amount of the monomers. Thereafter, the mixture was heated to 190° C. over about 3 hours, and heated to 220° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A'-4.

Next, a reaction vessel equipped with a condenser, a stirrer and a nitrogen-introducing pipe was charged with Intermediate Polyester A'-4, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A'-4.

—Synthesis of Non-Crystalline Polyester Resin A'-4—

Prepolymer A'-4 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A'-4. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A'-4. Physical properties of Non-Crystalline Polyester Resin A'-4 are depicted in Table 1-5.

Production Example A'-5

<Synthesis of Non-Crystalline Polyester Resin A'-5>

—Synthesis of Prepolymer A'-5—

A reaction vessel equipped with a condenser, a stirrer and a nitrogen-introducing pipe was charged with 3-methyl-1,5-pentanediol, isophthalic acid, and adipic acid, together with titanium tetraisopropoxide (1,000 ppm relative to the resin component), so that the molar ratio of hydroxyl groups to carboxyl groups, represented by OH/COOH, was 1.5, the diol component was composed of 100 mol % of 3-methyl-1,5-pentanediol, the dicarboxylic acid component was composed of 40 mol % of isophthalic acid and 60 mol % of adipic acid. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A'-5.

Next, a reaction vessel equipped with a condenser, a stirrer and a nitrogen-introducing pipe was charged with Intermediate Polyester A'-5, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A'-5 (linear chain reactive precursor).

—Synthesis of Non-Crystalline Polyester Resin A'-5—

Prepolymer A'-5 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A'-5. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A'-5. Physical properties of Non-Crystalline Polyester Resin A'-5 are depicted in Table 1-5.

Production Example A'-6

<Synthesis of Non-Crystalline Polyester Resin A'-6>

—Synthesis of Prepolymer A'-6—

A reaction vessel equipped with a condenser, a stirrer and a nitrogen-introducing pipe was charged with bisphenol A ethylene oxide 2 mol adduct, bisphenol A propylene oxide 3 mol adduct, isophthalic acid, and adipic acid, together with titanium tetraisopropoxide (1,000 ppm relative to the resin component), so that the molar ratio of the bisphenol A ethylene oxide 2 mol adduct to the bisphenol A propylene oxide 3 mol adduct (bisphenol A ethylene oxide 2 mol adduct/bisphenol A propylene oxide 3 mol adduct) was 80/20, the molar ratio of isophthalic acid to adipic acid (isophthalic acid/adipic acid) was 85/15, the molar ratio of hydroxyl groups to carboxyl groups, represented by OH/COOH, was 1.5, and an amount of trimellitic anhydride was 1 mol % relative to the total amount of the monomers. Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield Intermediate Polyester A'-6.

Next, a reaction vessel equipped with a condenser, a stirrer and a nitrogen-introducing pipe was charged with Intermediate Polyester A'-6, and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain Prepolymer A'-6.

—Synthesis of Non-Crystalline Polyester Resin A'-6—

Prepolymer A'-6 was stirred in a reaction vessel equipped with a heating device, stirrer, and nitrogen inlet tube, and into the reaction vessel, Ketimine Compound 1 was added dropwise so that the amount of the amine of Ketimine Compound 1 was equimolar to the amount of the isocyanate of Prepolymer A'-6. After stirring for 10 hours at 45° C., a resulting prepolymer elongated product was taken out. The obtained prepolymer elongated product was dried at 50° C. under reduced pressure until the amount of the ethyl acetate residues in the prepolymer elongated product became 100 ppm or less, to thereby obtain Non-Crystalline Polyester Resin A'-6. Physical properties of Non-Crystalline Polyester Resin A'-6 are depicted in Table 1-5.

Production Example B-1

<Synthesis of Non-Crystalline Polyester Resin B-1>

A four necked flask equipped with a nitrogen-introducing pipe, a drainpipe, a stirrer and a thermocouple was charged with bisphenol A ethylene oxide 2 mol adduct, bisphenol A propylene oxide 3 mol adduct, isophthalic acid, and adipic acid, so that the molar ratio of the bisphenol A ethylene oxide 2 mol adduct to the bisphenol A propylene oxide 3 mol adduct (bisphenol A ethylene oxide 2 mol adduct/bisphenol A propylene oxide 3 mol adduct) was 85/15, the molar ratio of isophthalic acid to adipic acid (isophthalic acid/adipic acid) was 80/20, and the molar ratio of hydroxyl groups to carboxyl groups, represented by OH/COOH, was 1.3. The resulting mixture was allowed react with titanium tetraisopropoxide (500 ppm relative to the resin component) for 8 hours at 230° C. under atmospheric pressure, and was further reacted for 4 hours under the reduced pressure of 10 mmHg to 15 mmHg. Thereafter, trimellitic anhydride was added to the reaction vessel in an amount of 1 mol % relative to the entire resin component, and the resultant was allowed to react for 3 hours at 180° C., under atmospheric pressure, to thereby obtain Non-Crystalline Polyester Resin B-1. Physical properties of Non-Crystalline Polyester Resin B-1 are depicted in Tables 1-1 to 1-2, and 1-4 to 1-5.

Production Example B-2

<Synthesis of Non-Crystalline Polyester Resin B-2>

A four necked flask equipped with a nitrogen-introducing pipe, a drainpipe, a stirrer and a thermocouple was charged with bisphenol A ethylene oxide 2 mol adduct, bisphenol A propylene oxide 3 mol adduct, isophthalic acid, and adipic acid so that the molar ratio of the bisphenol A ethylene oxide 2 mol adduct to the bisphenol A propylene oxide 3 mol adduct (bisphenol A ethylene oxide 2 mol adduct/bisphenol A propylene oxide 3 mol adduct) was 75/25, the molar ratio of isophthalic acid to adipic acid (isophthalic acid/adipic acid) was 70/30, and the molar ratio of hydroxyl groups to carboxyl groups, represented by OH/COOH, was 1.4. The resulting mixture was allowed react with titanium tetraisopropoxide (500 ppm relative to the resin component) for 8 hours at 230°

C. under atmospheric pressure, and was further reacted for 4 hours under the reduced pressure of 10 mmHg to 15 mmHg. Thereafter, trimellitic anhydride was added to the reaction vessel in an amount of 1 mol % relative to the entire resin component, and the resultant was allowed to react for 3 hours at 180° C., under atmospheric pressure, to thereby obtain Non-Crystalline Polyester Resin B-2. Physical properties of Non-Crystalline Polyester Resin B-2 are depicted in Table 1-1.

Production Example B-3

<Synthesis of Non-Crystalline Polyester Resin B-3>

A four necked flask equipped with a nitrogen-introducing pipe, a drainpipe, a stirrer and a thermocouple was charged with bisphenol A ethylene oxide 2 mol adduct, isophthalic acid, and adipic acid, so that the molar ratio of isophthalic acid to adipic acid (isophthalic acid/adipic acid) was 90/10, and the molar ratio of hydroxyl groups to carboxyl groups, represented by OH/COOH, was 1.2. The resulting mixture was allowed react with titanium tetraisopropoxide (1,000 ppm relative to the resin component) for 10 hours at 230° C. under atmospheric pressure, and was further reacted for 5 hours under the reduced pressure of 10 mmHg to 15 mmHg. Thereafter, trimellitic anhydride was added to the reaction vessel in an amount of 1 mol % relative to the entire resin component, and the resultant was allowed to react for 3 hours at 180° C., under atmospheric pressure, to thereby obtain Non-Crystalline Polyester Resin B-3. Physical properties of Non-Crystalline Polyester Resin B-3 are depicted in Table 1-1.

Production Example B-4

<Synthesis of Non-Crystalline Polyester Resin B-4>

A four necked flask equipped with a nitrogen-introducing pipe, a drainpipe, a stirrer and a thermocouple was charged with bisphenol A ethylene oxide 2 mol adduct, bisphenol A propylene oxide 3 mol adduct, isophthalic acid, and adipic acid, so that the molar ratio of the bisphenol A ethylene oxide 2 mol adduct to the bisphenol A propylene oxide 3 mol adduct (bisphenol A ethylene oxide 2 mol adduct/bisphenol A propylene oxide 3 mol adduct) was 80/20, the molar ratio of isophthalic acid to adipic acid (isophthalic acid/adipic acid) was 85/15, and the molar ratio of hydroxyl groups to carboxyl groups, represented by OH/COOH, was 1.3. The resulting mixture was allowed react with titanium tetraisopropoxide (500 ppm relative to the resin component) for 8 hours at 230° C. under atmospheric pressure, and was further reacted for 4 hours under the reduced pressure of 10 mmHg to 15 mmHg. Thereafter, trimellitic anhydride was added to the reaction vessel in an amount of 1 mol % relative to the entire resin component, and the resultant was allowed to react for 3 hours at 180° C., under atmospheric pressure, to thereby obtain Non-Crystalline Polyester Resin B-4. Physical properties of Non-Crystalline Polyester Resin B-4 are depicted in Tables 1-3 to 1-5.

Production Example B-5

<Synthesis of Non-Crystalline Polyester Resin B-5>

A four necked flask equipped with a nitrogen-introducing pipe, a drainpipe, a stirrer and a thermocouple was charged with bisphenol A ethylene oxide 2 mol adduct, bisphenol A propylene oxide 3 mol adduct, isophthalic acid, and adipic acid, so that the molar ratio of the bisphenol A ethylene oxide 2 mol adduct to the bisphenol A propylene oxide 3 mol adduct (bisphenol A ethylene oxide 2 mol adduct/bisphenol A propylene oxide 3 mol adduct) was 80/20, the molar ratio of isophthalic acid to adipic acid (isophthalic acid/adipic acid) was 74/26, and the molar ratio of hydroxyl groups to carboxyl groups, represented by OH/COOH, was 1.3. The resulting mixture was allowed react with titanium tetraisopropoxide (500 ppm relative to the resin component) for 8 hours at 230° C. under atmospheric pressure, and was further reacted for 4 hours under the reduced pressure of 10 mmHg to 15 mmHg. Thereafter, trimellitic anhydride was added to the reaction vessel in an amount of 1 mol % relative to the entire resin component, and the resultant was allowed to react for 3 hours at 180° C., under atmospheric pressure, to thereby obtain Non-Crystalline Polyester Resin B-5. Physical properties of Non-Crystalline Polyester Resin B-5 are depicted in Tables 1-3 to 1-4.

Production Example B'-1

<Synthesis of Non-Crystalline Polyester Resin B'-1>

A four necked flask equipped with a nitrogen-introducing pipe, a drainpipe, a stirrer and a thermocouple was charged with bisphenol A ethylene oxide 2 mol adduct, bisphenol A propylene oxide 3 mol adduct, isophthalic acid, and adipic acid, so that the molar ratio of the bisphenol A ethylene oxide 2 mol adduct to the bisphenol A propylene oxide 3 mol adduct (bisphenol A ethylene oxide 2 mol adduct/bisphenol A propylene oxide 3 mol adduct) was 75/25, the molar ratio of isophthalic acid to adipic acid (isophthalic acid/adipic acid) was 65/35, and the molar ratio of hydroxyl groups to carboxyl groups, represented by OH/COOH, was 1.4. The resulting mixture was allowed react with titanium tetraisopropoxide (500 ppm relative to the resin component) for 8 hours at 230° C. under atmospheric pressure, and was further reacted for 4 hours under the reduced pressure of 10 mmHg to 15 mmHg. Thereafter, trimellitic anhydride was added to the reaction vessel in an amount of 1 mol % relative to the entire resin component, and the resultant was allowed to react for 3 hours at 180° C., under atmospheric pressure, to thereby obtain Non-Crystalline Polyester Resin B'-1. Physical properties of Non-Crystalline Polyester Resin B'-1 are depicted in Table 1-2.

Production Example B'-2

<Synthesis of Non-Crystalline Polyester Resin B'-2>

A four necked flask equipped with a nitrogen-introducing pipe, a drainpipe, a stirrer and a thermocouple was charged with bisphenol A ethylene oxide 2 mol adduct, isophthalic acid, and adipic acid, so that the molar ratio of isophthalic acid to adipic acid (isophthalic acid/adipic acid) was 95/5, and the molar ratio of hydroxyl groups to carboxyl groups, represented by OH/COOH, was 1.15. The resulting mixture was allowed react with titanium tetraisopropoxide (1,000 ppm relative to the resin component) for 10 hours at 230° C. under atmospheric pressure, and was further reacted for 5 hours under the reduced pressure of 10 mmHg to 15 mmHg. Thereafter, trimellitic anhydride was added to the reaction vessel in an amount of 1 mol % relative to the entire resin component, and the resultant was allowed to react for 3 hours at 180° C., under atmospheric pressure, to thereby obtain Non-Crystalline Polyester Resin B'-2. Physical properties of Non-Crystalline Polyester Resin B'-2 are depicted in Table 1-2.

Production Example C-1

<Synthesis of Crystalline Polyester Resin C-1>

A 5 L four necked flask equipped with a nitrogen-introducing pipe, a drainpipe, a stirrer and a thermocouple was charged with dodecanedioic acid, and 1,6-hexanediol, so that the molar ratio of hydroxyl groups to carboxyl groups, represented by OH/COOH, was 0.9, the acid component was composed of 100 mol % of dodecanedioic acid, and the alcohol component was composed of 100 mol % of 1,6-hexanediol. The resulting mixture was allowed react with titanium tetraisopropoxide (500 ppm relative to the resin component) for 10 hours at 180° C., and the heated to 200° C. and reacted for 3 hours, followed by further reacting for 2 hours under the pressure of 8.3 kPa, to thereby obtain Crystalline Polyester Resin C-1. Physical properties of Crystalline Polyester Resin C-1 are depicted in Tables 1-1 to 1-5.

Production Example C-2

<Synthesis of Crystalline Polyester Resin C-2>

A 5 L four necked flask equipped with a nitrogen-introducing pipe, a drainpipe, a stirrer and a thermocouple was charged with adipic acid, 1,6-hexanediol, and 1,4-butanediol, so that the molar ratio of hydroxyl groups to carboxyl groups, represented by OH/COOH, was 0.9, the acid component was composed of 100 mol % of adipic acid, and the alcohol component was composed of 50 mol % of 1,6-hexanediol and 50 mol % of 1,4-butanediol. The resulting mixture was allowed react with titanium tetraisopropoxide (500 ppm relative to the resin component) for 10 hours at 180° C., and the heated to 200° C. and reacted for 3 hours, followed by further reacting for 2 hours under the pressure of 8.3 kPa, to thereby obtain Crystalline Polyester Resin C-2. Physical properties of Crystalline Polyester Resin C-2 are depicted in Table 1-1.

Production Example C-3

<Synthesis of Crystalline Polyester Resin C-3>

A 5 L four necked flask equipped with a nitrogen-introducing pipe, a drainpipe, a stirrer and a thermocouple was charged with terephthalic acid, 1,6-hexanediol, and 1,4-butanediol, so that the molar ratio of hydroxyl groups to carboxyl groups, represented by OH/COOH, was 0.9, the acid component was composed of 100 mol % of terephthalic acid, and the alcohol component was composed of 50 mol % of 1,6-hexanediol and 50 mol % of 1,4-butanediol. The resulting mixture was allowed react with titanium tetraisopropoxide (500 ppm relative to the resin component) for 10 hours at 180° C., and the heated to 200° C. and reacted for 3 hours, followed by further reacting for 2 hours under the pressure of 8.3 kPa, to thereby obtain Crystalline Polyester Resin C-3. Physical properties of Crystalline Polyester Resin C-3 are depicted in Table 1-1.

Production Example C-4

<Synthesis of Crystalline Polyester Resin C-4>

A 5 L four necked flask equipped with a nitrogen-introducing pipe, a drainpipe, a stirrer and a thermocouple was charged with octanedioic acid, and 1,6-hexanediol, so that the molar ratio of hydroxyl groups to carboxyl groups, represented by OH/COOH, was 0.9, the acid component was composed of 100 mol % of octanedioic acid, and the alcohol component was composed of 100 mol % of 1,6-hexanediol. The resulting mixture was allowed react with titanium tetraisopropoxide (500 ppm relative to the resin component) for 10 hours at 180° C., and the heated to 200° C. and reacted for 3 hours, followed by further reacting for 2 hours under the pressure of 8.3 kPa, to thereby obtain Crystalline Polyester Resin C-4. Physical properties of Crystalline Polyester Resin C-4 are depicted in Tables 1-3 to 1-4.

Production Example C-5

<Synthesis of Crystalline Polyester Resin C-5>

A 5 L four necked flask equipped with a nitrogen-introducing pipe, a drainpipe, a stirrer and a thermocouple was charged with decanedioic acid, and ethylene glycol, so that the molar ratio of hydroxyl groups to carboxyl groups, represented by OH/COOH, was 0.9, the acid component was composed of 100 mol % of decanedioic acid, and the alcohol component was composed of 100 mol % of ethylene glycol. The resulting mixture was allowed react with titanium tetraisopropoxide (500 ppm relative to the resin component) for 10 hours at 200° C., and the heated to 220° C. and reacted for 3 hours, followed by further reacting for 2 hours under the pressure of 8.3 kPa, to thereby obtain Crystalline Polyester Resin C-5. Physical properties of Crystalline Polyester Resin C-5 are depicted in Table 1-3.

Example 1

<Synthesis of Master Batch (MB)>

Water (1,200 parts), 500 parts of carbon black (Printex 35, manufactured by Evonik Degussa Japan Co., Ltd.) [DBP oil absorption amount=42 mL/100 mg, pH=9.5], and 500 parts of Non-Crystalline Polyester Resin B-1 were added and mixed together by means of HENSCHEL MIXER (manufactured by NIPPON COLE & ENGINEERING CO., LTD.), and the resulting mixture was kneaded by means of a two roll mill for 30 minutes at 150° C. The resulting kneaded product was rolled out and cooled, followed by pulverizing by a pulverizer, to thereby obtain Master Batch 1.

<Preparation of Wax Dispersion Liquid>

A vessel to which a stirring bar and a thermometer had been set was charged with 50 parts of paraffin wax (HNP-9, manufactured by Nippon Seiro Co., Ltd., hydrocarbon wax, melting point: 75° C., SP value: 8.8) as Releasing Agent 1, and 450 parts of ethyl acetate, followed by heating to 80° C. with mixing. The temperature was maintained at 80° C. for 5 hours, followed by cooling to 30° C. over 1 hour. The resulting mixture was dispersed by means of a bead mill (ULTRA VISCOMILL, product of AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain Wax Dispersion Liquid 1.

<Preparation of Crystalline Polyester Resin Dispersion Liquid>

A vessel equipped with a stirring bar and a thermometer was charged with 50 parts of Crystalline Polyester Resin C-1, and 450 parts of ethyl acetate, and the resulting mixture was heated to 80° C. with stirring. The temperature was kept at 80° C. for 5 hours, followed by cooling to 30° C. over 1 hour. The resultant was dispersed by means of a bead mill (ULTRA VISCOMILL, manufactured by AIMEX CO., LTD.), under the following conditions: a liquid feed rate of 1 kg/hr, disc circumferential velocity of 6 m/s, 0.5 mm-zirconia beads packed to 80% by volume, and 3 passes, to thereby obtain Crystalline Polyester Resin Dispersion Liquid 1.

<Preparation of Oil Phase>

A vessel was charged with 500 parts of Wax Dispersion Liquid 1, 300 parts of Prepolymer A-1, 500 parts of Crystalline Polyester Resin Dispersion Liquid 1, 700 parts of Non-Crystalline Polyester Resin B-1, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 1.

—Synthesis of Organic Particle Emulsion (Particle Dispersion Liquid)—

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, manufactured by Sanyo Chemical Industries, Ltd.), 138 parts of styrene, 138 parts of methacrylic acid, and 1 part of ammonium persulfate, and the resulting mixture was stirred for 15 minutes at 400 rpm, to thereby obtain a white emulsion. The obtained emulsion was heated to have the system temperature of 75° C., and was then allowed to react for 5 hours. To the resultant, 30 parts of a 1% ammonium persulfate aqueous solution was added, followed by aging for 5 hours at 75° C., to thereby obtain an aqueous dispersion liquid of a vinyl resin (a copolymer of styrene/methacrylic acid/sodium salt of sulfuric acid ester of methacrylic acid ethylene oxide adduct), i.e., Particle Dispersoin Liquid 1.

Particle Dispersion Liquid 1 was measured by means of LA-920 (manufactured by HORIBA, Ltd.), and as a result, the volume average particle diameter thereof was found to be 0.14 μm. Part of Particle Dispersion Liquid 1 was dried, and a resin component thereof was isolated.

<Preparation of Aqueous Phase>

Water (990 parts), 83 parts of Particle Dispersion Liquid 1, 37 parts of a 48.5% aqueous solution of sodium dodecyldiphenyl ether disulfonate (ELEMINOL MON-7, manufactured by Sanyo Chemical Industries Ltd.), and 90 parts of ethyl acetate were mixed and stirred, to thereby obtain an opaque white liquid. The obtained liquid was used as Aqueous Phase 1.

<Emulsification and Removal of Solvent>

To a container charged with Oil Phase 1, 1,200 parts of Aqueous Phase 1 was added, and the resulting mixture was mixed by means of a TK homomixer at 13,000 rpm for 20 minutes, to thereby obtain Emulsified Slurry 1.

A container equipped with a stirrer and a thermometer was charged with Emulsified Slurry 1, followed by removing the solvent therein at 30° C. for 8 hours. Thereafter, the resultant was matured at 45° C. for 4 hours, to thereby obtain Dispersion Slurry 1.

<Washing and Drying>

After subjecting 100 parts of Dispersion Slurry 1 to filtration under the reduced pressure, the resultant was subjected twice to a series of treatments (1) to (4) described below, to thereby produce Filtration Cake 1;

(1); ion-exchanged water (100 parts) was added to the filtration cake, followed by mixing with TK Homomixer (at 12,000 rpm for 10 minutes) and then filtration;

(2): 10% aqueous sodium hydroxide solution (100 parts) was added to the filtration cake obtained in (1), followed by mixing with TK Homomixer (at 12,000 rpm for 30 minutes) and then filtration under reduced pressure;

(3): 10% by mass hydrochloric acid (100 parts) was added to the filtration cake obtained in (2), followed by mixing with TK Homomixer (at 12,000 rpm for 10 minutes) and then filtration; and (4): ion-exchanged water (300 parts) was added to the filtration cake obtained in (3), followed by mixing with TK Homomixer (at 12,000 rpm for 10 minutes) and then filtration.

Filtration Cake 1 was dried with an air-circulating drier at 45° C. for 48 hours, and then was caused to pass through a sieve with a mesh size of 75 μm, to thereby prepare Toner 1.

The component ratio, phase of the probe as measured by the tapping mode of AFM, area ratio, Tg1st, and Tg2nd of the obtained toner are depicted in Table 1-1.

Example 2

Toner 2 was obtained in the same manner as in Example 1, provided that Prepolymer A-1 was replaced with Prepolymer A-2.

Example 3

Toner 3 was obtained in the same manner as in Example 1, provided that Prepolymer A-1 was replaced with Prepolymer A-3.

Example 4

Toner 4 was obtained in the same manner as in Example 1, provided that Non-Crystalline Polyester Resin B-1 was replaced with Non-Crystalline Polyester Resin B-2.

Example 5

Toner 5 was obtained in the same manner as in Example 1, provided that Non-Crystalline Polyester Resin B-1 was replaced with Non-Crystalline Polyester Resin B-3, and moreover, in the preparation of an oil phase, 700 parts of Non-Crystalline Polyester Resin B-1 was replaced with 600 parts of Non-Crystalline Polyester Resin B-3.

Example 6

Toner 6 was obtained in the same manner as in Example 1, provided that Crystalline Polyester Resin C-1 was replaced with Crystalline Polyester Resin C-2.

Example 7

Toner 7 was obtained in the same manner as in Example 1, provided that Crystalline Polyester Resin C-1 was replaced with Crystalline Polyester Resin C-3.

Comparative Example 1

Toner 8 was obtained in the same manner as in Example 1, provided that Prepolymer A-1 was replaced with Prepolymer A'-1.

Comparative Example 2

Toner 9 was obtained in the same manner as in Example 1, provided that Prepolymer A-1 was replaced with Prepolymer A'-2.

Comparative Example 3

Toner 10 was obtained in the same manner as in Example 1, provided that Non-Crystalline Polyester Resin B-1 was replaced with Non-Crystalline Polyester Resin B'-1.

Comparative Example 4

Toner 11 was obtained in the same manner as in Example 1, provided that Non-Crystalline Polyester Resin B-1 was replaced with Non-Crystalline Polyester Resin B'-2, and moreover in the preparation of oil phase, the amount of Prepolymer A-1 was changed from 300 parts to 600 parts, and 700 parts of Non-Crystalline Polyester Resin B-1 was replaced with 550 parts of Non-Crystalline Polyester Resin B'-2.

Comparative Example 5

Toner 12 was obtained in the same manner as in Example 1, provided that, in the preparation of the oil phase, 300 parts of Prepolymer A-1 was replaced with 200 parts of Prepolymer A'-1, and the amount of Non-Crystalline Polyester Resin B-1 was changed from 700 parts to 750 parts.

Comparative Example 6

Toner 13 was obtained in the same manner as in Example 1, provided that, in the preparation of the oil phase, 300 parts of Prepolymer A-1 was changed to 400 parts of Prepolymer A'-2, and the amount of Non-Crystalline Polyester Resin B-1 was changed from 700 parts to 650 parts.

Comparative Example 7

Toner 14 was obtained in the same manner as in Example 1, provided that, in the preparation of the oil phase, the amount of Crystalline Polyester Dispersion Liquid 1 was changed from 500 parts to 0 parts, and the amount of Non-Crystalline Polyester Resin B-1 was changed from 700 parts to 750 parts.

Example 8

Toner 15 was obtained in the same manner as in Example 1, provided that Prepolymer A-1 was replaced with Prepolymer A-4, and Non-Crystalline Polyester Resin B-1 was replaced with Non-Crystalline Polyester Resin B-4.

Example 9

Toner 16 was obtained in the same manner as in Example 8, provided that Prepolymer A-4 was replaced with Prepolymer A-5, and Crystalline Polyester Resin C-1 was replaced with Crystalline Polyester Resin C-4.

Example 10

Toner 17 was obtained in the same manner as in Example 8, provided that Prepolymer A-4 was replaced with Prepolymer A-6.

Example 11

Toner 18 was obtained in the same manner as in Example 8, provided that Prepolymer A-4 was replaced with Prepolymer A-6, and Non-Crystalline Polyester Resin B-4 was replaced with Non-Crystalline Polyester Resin B-5.

Example 12

Toner 19 was obtained in the same manner as in Example 8, provided that Crystalline Polyester Resin C-1 was replaced with Crystalline Polyester Resin C-5.

Example 13

Toner 20 was obtained in the same manner as in Example 8, provided that Oil Phase 1 was replaced with Oil Phase 2 prepared as in the following manner.

<Preparation of Oil Phase>

A vessel was charged with 500 parts of Wax Dispersion Liquid 1, 50 parts of Prepolymer A-4, 80 parts of Crystalline Polyester Resin Dispersion Liquid 1, 700 parts of Non-Crystalline Polyester Resin B-4, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 2.

Example 14

Toner 21 was obtained in the same manner as in Example 8, provided that Oil Phase 1 was replaced with Oil Phase 3 prepared in the following manner.

<Preparation of Oil Phase>

A vessel was charged with 500 parts of Wax Dispersion Liquid 1, 350 parts of Prepolymer A-4, 550 parts of Crystalline Polyester Resin Dispersion Liquid 1, 700 parts of Non-Crystalline Polyester Resin B-4, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 3.

Example 15

Toner 22 was obtained in the same manner as in Example 8, provided that Prepolymer A-4 was replaced with Prepolymer A-5, and Crystalline Polyester Resin C-1 was replaced with Crystalline Polyester Resin C-5.

Example 16

Toner 23 was obtained in the same manner as in Example 8, provided that Prepolymer A-4 was replaced with Prepolymer A-7, and Non-Crystalline Polyester Resin B-4 was replaced with Non-Crystalline Polyester Resin B-5.

Example 17

Toner 24 was obtained in the same manner as in Example 8, provided that Oil Phase 1 was replaced with Oil Phase 4 prepared in the following manner.

<Preparation of Oil Phase>

A vessel was charged with 500 parts of Wax Dispersion Liquid 1, 40 parts of Prepolymer A-4, 70 parts of Crystalline Polyester Resin Dispersion Liquid 1, 700 parts of Non-Crystalline Polyester Resin B-4, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 4.

Example 18

Toner 25 was obtained in the same manner as in Example 8, provided that Oil Phase 1 was replaced with Oil Phase 5 prepared in the following manner.

<Preparation of Oil Phase>

A vessel was charged with 500 parts of Wax Dispersion Liquid 1, 360 parts of Prepolymer A-4, 560 parts of Crystalline Polyester Resin Dispersion Liquid 1, 700 parts of Non-Crystalline Polyester Resin B-4, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 5.

Example 19

Toner 26 was obtained in the same manner as in Example 8, provided that Prepolymer A-4 was replaced with Prepolymer A-8, and Crystalline Polyester Resin C-1 was replaced with Crystalline Polyester Resin C-4.

Example 20

Toner 27 was obtained in the same manner as in Example 8, provided that Prepolymer A-4 was replaced with Prepolymer A-9.

Example 21

Toner 28 was obtained in the same manner as in Example 8, provided that Non-Crystalline Polyester Resin B-4 was replaced with Non-Crystalline Polyester Resin B-1, and Oil Phase 1 was replaced with Oil Phase 6 prepared in the following manner.

<Preparation of Oil Phase>

A vessel was charged with 500 parts of Wax Dispersion Liquid 1, 400 parts of Prepolymer A-1, 560 parts of Crystalline Polyester Resin Dispersion Liquid 1, 660 parts of Non-Crystalline Polyester Resin B-1, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 6.

Example 22

Toner 29 was obtained in the same manner as in Example 8, provided that Non-Crystalline Polyester Resin B-4 was replaced with Non-Crystalline Polyester Resin B-1, and Oil Phase 1 was replaced with Oil Phase 7 prepared in the following manner.

<Preparation of Oil Phase>

A vessel was charged with 500 parts of Wax Dispersion Liquid 1, 230 parts of Prepolymer A-1, 450 parts of Crystalline Polyester Resin Dispersion Liquid 1, 760 parts of Non-Crystalline Polyester Resin B-1, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 7.

Example 23

Toner 30 was obtained in the same manner as in Example 8, provided that Non-Crystalline Polyester Resin B-4 was replaced with Non-Crystalline Polyester Resin B-1, and Oil Phase 1 was replaced with Oil Phase 8 prepared in the following manner.

<Preparation of Oil Phase>

A vessel was charged with 500 parts of Wax Dispersion Liquid 1, 190 parts of Prepolymer A-1, 420 parts of Crystalline Polyester Resin Dispersion Liquid 1, 780 parts of Non-Crystalline Polyester Resin B-1, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 8.

Example 24

Toner 31 was obtained in the same manner as in Example 8, provided that Non-Crystalline Polyester Resin B-4 was replaced with Non-Crystalline Polyester Resin B-1, and Oil Phase 1 was replaced with Oil Phase 9 prepared in the following manner.

<Preparation of Oil Phase>

A vessel was charged with 500 parts of Wax Dispersion Liquid 1, 450 parts of Prepolymer A-1, 650 parts of Crystalline Polyester Resin Dispersion Liquid 1, 640 parts of Non-Crystalline Polyester Resin B-1, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 9.

Example 25

Toner 32 was obtained in the same manner as in Example 8, provided that Prepolymer A-4 was replaced with Prepolymer A-10, and Non-Crystalline Polyester Resin B-4 was replaced with Non-Crystalline Polyester Resin B-1.

Example 26

Toner 33 was obtained in the same manner as in Example 8, provided that Prepolymer A-4 was replaced with Prepolymer A-11, and Non-Crystalline Polyester Resin B-4 was replaced with Non-Crystalline Polyester Resin B-1.

Comparative Example 8

Toner 34 was obtained in the same manner as in Example 8, provided that Prepolymer A-4 was replaced with Prepolymer A'-3.

Comparative Example 9

Toner 35 was obtained in the same manner as in Example 8, provided that Prepolymer A-4 was replaced with Prepolymer A'-4.

Comparative Example 10

Toner 36 was obtained in the same manner as in Example 8, provided that Oil Phase 1 was replaced with Oil Phase 10.

<Preparation of Oil Phase>

A vessel was charged with 500 parts of Wax Dispersion Liquid 1, 700 parts of Non-Crystalline Polyester Resin B-4, 100 parts of Master Batch 1, and 2 parts of Ketimine Compound 1, and the resulting mixture was mixed by means of a TK homomixer (manufactured by PRIMIX Corporation) at 5,000 rpm for 60 minutes, to thereby obtain Oil Phase 10.

Comparative Example 12

Toner 38 was obtained in the same manner as in Example 8, provided that Prepolymer A-4 was replaced with Prepolymer A'-5, and Non-Crystalline Polyester Resin B-4 was replaced with Non-Crystalline Polyester Resin B-1.

Comparative Example 13

Toner 39 was obtained in the same manner as in Example 8, Prepolymer A-4 was replaced with Prepolymer A'-6, and Non-Crystalline Polyester Resin B-4 was replaced with Non-Crystalline Polyester Resin B-1.

<Evaluation>

The obtained toners were each used to produce a developer in the following manner, and resulted developers were evaluated in the following manner. The results are presented in Tables 1-1 to 1-5.

<<Production of Developer Liquid>>

—Production of Carrier—

To 100 parts of toluene, 100 parts of a silicone resin organo straight silicone, 5 parts of γ-(2-aminoethyl)aminopropyltrimethoxy silane, and 10 parts of carbon black were added, and the resulting mixture was dispersed by means of a homomixer for 20 minutes, to thereby prepare a resin layer coating liquid. To surfaces of spherical magnetite particles having the average particle diameter of 50 μm (1,000 parts) the resin layer coating liquid was applied by means of a fluidized bed coating device, to thereby prepare a carrier.

—Production of Developer—

By means of a ball mill, 5 parts of the toner and 95 parts of the carrier were mixed, to thereby produce a developer.

<<Low Temperature Fixing Ability, and Hot Offset Resistance>>

A printing test was performed on Type 6200 Paper (manufactured by Ricoh Company Limited) by means of a photocopier MF 2200 (manufactured by Ricoh Company Limited) in which a Teflon (registered trade mark) roller was used as a fixing roller.

Specifically, cold offset temperature (minimum fixing temperature) and hot offset temperature (maximum fixing temperature) were determined by varying the fixing temperature.

The evaluation conditions of the minimum fixing temperature were a paper feeding linear velocity of 120 mm/sec to 150 mm/sec, bearing of 1.2 kgf/cm$^2$, and nip width of 3 mm.

Moreover, the evaluation conditions of the maximum fixing temperature were a paper feeding linear velocity of 50 mm/sec, bearing of 2.0 kgf/cm$^2$, and nip width of 4.5 mm.

<<Heat Resistant Storage Stability>>

After storing the toner for 8 hours at 50° C., the toner was sieved with a 42-mesh sieve for 2 minutes, and then a residual rate of the toner on the wire gauze was measured. The residual rate of the toner is smaller, as the heat resistant storage stability of the toner is better.

Note that, the evaluation criteria for heat resistant storage stability is as follows:

A: The residual rate was less than 10%.

B: The residual rate was 10% or more but less than 20%.

C: The residual rate was 20% or more but less than 30%.

D: The residual rate was 30% or more.

<<Filming>>

An image was formed on 10,000 sheets by means of an image forming apparatus MF2800 (manufactured by Ricoh Company Limited). Thereafter, a photoconductor in the image forming apparatus was visually observed whether there was any deposition, mainly of a releasing agent, on the photoconductor. The results were evaluated based on the following criteria.

A: No deposition of a toner component was confirmed on the photoconductor.

B: A deposition of a toner component was confirmed on the photoconductor, but it was not a problematic level on practical use.

C: A deposition of a toner component was confirmed on the photoconductor, which was at the level where a problem may have occurred on practical use.

D: A deposition of a toner component was confirmed on the photoconductor, which was at the level where a problem may have occurred significantly on practical use.

TABLE 1-1

| | | Ex. 1 | Ex. 2 | Ex. 3 | Ex. 4 |
|---|---|---|---|---|---|
| Toner No. | | 1 | 2 | 3 | 4 |
| Non-crystalline polyester resin A | Type | A-1 | A-2 | A-3 | A-1 |
| | Mw | 150,000 | 120,000 | 130,000 | 150,000 |
| | Diol | 3-methyl-1,5-pentanediol 100% | Hexanediol 100% | 3-methyl-1,5-pentanediol 100% | 3-methyl-1,5-pentanediol 100% |
| | Dicarboxylic acid | Isophthalic acid 40%/ Adipic acid 60% | Isophthalic acid 80%/Adipic acid 20% | Adipic acid 100% | Isophthalic acid 40%/Adipic acid 60% |
| | SP1 | 10.59 | 11.02 | 10.15 | 10.59 |
| | Tg | −40° C. | −5° C. | −55° C. | −40° C. |
| Non-crystalline polyester resin B | Type | B-1 | B-1 | B-1 | B-2 |
| | Mw | 5,000 | 5,000 | 5,000 | 4,500 |
| | Diol | BisA-EO 85%/ BisA-PO 15% | BisA-EO 85%/ BisA-PO 15% | BisA-EO 85%/ BisA-PO 15% | BisA-EO 75%/ BisA-PO 25% |
| | Dicarboxylic acid | Isophthalic acid 80%/ Adipic acid 20% | Isophthalic acid 80%/Adipic acid 20% | Isophthalic acid 80%/Adipic acid 20% | Isophthalic acid 70%/Adipic acid 30% |
| | SP2 | 11.07 | 11.07 | 11.07 | 10.99 |
| | Tg | 48° C. | 48° C. | 48° C. | 42° C. |
| Crystalline polyester resin C | Type | C-1 | C-1 | C-1 | C-1 |
| | Diol | Hexanediol 100% | Hexanediol 100% | Hexanediol 100% | Hexanediol 100% |
| | Dicarboxylic acid | Dodecanedionic acid 100% | Dodecanedionic acid 100% | Dodecanedionic acid 100% | Dodecanedionic acid 100% |
| | SP3 | 9.71 | 9.71 | 9.71 | 9.71 |
| | Mw | 15,000 | 15,000 | 15,000 | 15,000 |
| | Mp | 70° C. | 70° C. | 70° C. | 70° C. |
| Component ratio (mass %) | Resin A | 15 | 15 | 15 | 15 |
| | Resin B | 70 | 70 | 70 | 70 |
| | Resin C | 5 | 5 | 5 | 5 |
| | Releasing agent | 5 | 5 | 5 | 5 |
| | Colorant | 5 | 5 | 5 | 5 |

TABLE 1-1-continued

| | | | | | |
|---|---|---|---|---|---|
| SP value | SP1 − SP3 | 0.88 | 1.31 | 0.44 | 0.88 |
| | SP2 − SP1 | 0.48 | 0.05 | 0.92 | 0.40 |
| Phase of probe in tapping mode of AFM | A (deg) | 70 | 62 | 72 | 70 |
| | B (deg) | 61 | 61 | 61 | 63 |
| | C (deg) | 68 | 68 | 68 | 68 |
| | A − B (deg) | 9 | 1 | 11 | 7 |
| Area ratio | (%) | 22 | 22 | 22 | 22 |
| Measurement and evaluation result | Tg1st | 30 | 36 | 26 | 27 |
| | Tg2nd | 15 | 20 | 13 | 15 |
| | Min. fixing | 95° C. | 100° C. | 95° C. | 95° C. |
| | Max. fixing | 190° C. | 200° C. | 185° C. | 185° C. |
| | Heat resistant storage stability | A | A | B | A |
| | Anti-filming | A | B | A | B |

| | | Ex. 5 | Ex. 6 | Ex. 7 |
|---|---|---|---|---|
| Toner No. | | 5 | 6 | 7 |
| Non-crystalline polyester resin A | Type | A-1 | A-1 | A-1 |
| | Mw | 150,000 | 150,000 | 150,000 |
| | Diol | 3-methyl-1,5-pentanediol 100% | 3-methyl-1,5-pentanediol 100% | 3-methyl-1,5-pentanediol 100% |
| | Dicarboxylic acid | Isophthalic acid 40%/Adipic acid 60% | Isophthalic acid 40%/Adipic acid 60% | Isophthalic acid 40%/Adipic acid 60% |
| | SP1 | 10.59 | 10.59 | 10.59 |
| | Tg | −40° C. | −40° C. | −40° C. |
| Non-crystalline polyester resin B | Type | B-3 | B-1 | B-1 |
| | Mw | 7,500 | 5,000 | 5,000 |
| | Diol | BisA-EO 100% | BisA-EO 85%/BisA-PO 15% | BisA-EO 85%/BisA-PO 15% |
| | Dicarboxylic acid | Isophthalic acid 90%/Adipic acid 10% | Isophthalic acid 80%/Adipic acid 20% | Isophthalic acid 80%/Adipic acid 20% |
| | SP2 | 11.14 | 11.07 | 11.07 |
| | Tg | 68° C. | 48° C. | 48° C. |
| Crystalline polyester resin C | Type | C-1 | C-2 | C-3 |
| | Diol | Hexanediol 100% | Hexanediol 50%/Butanediol 50% | Hexanediol 50%/Butanediol 50% |
| | Dicarboxylic acid | Dodecanedionic acid 100% | Adipic acid 100% | Terephthalic acid 100% |
| | SP3 | 9.71 | 10.39 | 11.52 |
| | Mw | 15,000 | 12,000 | 8,500 |
| | Mp | 70° C. | 58° C. | 82° C. |
| Component ratio (mass %) | Resin A | 25 | 15 | 15 |
| | Resin B | 60 | 70 | 70 |
| | Resin C | 5 | 5 | 5 |
| | Releasing agent | 5 | 5 | 5 |
| | Colorant | 5 | 5 | 5 |
| SP value | SP1 − SP3 | 0.88 | 0.20 | −0.93 |
| | SP2 − SP1 | 0.55 | 0.48 | 0.48 |
| Phase of probe in tapping mode of AFM | A (deg) | 70 | 70 | 70 |
| | B (deg) | 59 | 61 | 61 |
| | C (deg) | 68 | 70 | 66 |
| | A − B (deg) | 11 | 9 | 9 |
| Area ratio | (%) | 30 | 22 | 22 |
| Measurement and evaluation result | Tg1st | 38 | 30 | 30 |
| | Tg2nd | 25 | 17 | 22 |
| | Min. fixing | 100° C. | 95° C. | 105° C. |
| | Max. fixing | 210° C. | 185° C. | 210° C. |
| | Heat resistant storage stability | A | B | B |
| | Anti-filming | A | B | A |

TABLE 1-2

| | | Comp. Ex. 1 | Comp. Ex. 2 | Comp. Ex. 3 | Comp. Ex. 4 |
|---|---|---|---|---|---|
| Toner No. | | 8 | 9 | 10 | 11 |
| Non-crystalline polyester resin A | type | A'-1 | A'-2 | A-1 | A-1 |
| | Mw | 120,000 | 100,000 | 150,000 | 150,000 |
| | Diol | 3-methyl-1,5-pentanediol 100% | 3-methyl-1,5-pentanediol 100% | 3-methyl-1,5-pentanediol 100% | 3-methyl-1,5-pentanediol 100% |

TABLE 1-2-continued

| | | | | | |
|---|---|---|---|---|---|
| | Dicarboxylic acid | Isophthalic acid 100% | Decanedioic acid 100% | Isophthalic acid 40%/Adipic acid 60% | Isophthalic acid 40%/Adipic acid 60% |
| | SP1 | 11.23 | 9.78 | 10.59 | 10.59 |
| | Tg | 5° C. | −65° C. | −40° C. | −40° C. |
| Non-crystalline polyester resin B | Type | B-1 | B-1 | B'-1 | B'-2 |
| | Mw | 5,000 | 5,000 | 4,000 | 8,000 |
| | Diol | BisA-EO 85%/ BisA-PO 15% | BisA-EO 85%/ BisA-PO 15% | BisA-EO 75%/ BisA-PO 25% | BisA-EO 100% |
| | Dicarboxylic acid | Isophthalic acid 80%/Adipic acid 20% | Isophthalic acid 80%/Adipic acid 20% | Isophthalic acid 65%/Adipic acid 35% | Isophthalic acid 95%/Adipic acid 5% |
| | SP2 | 11.07 | 11.07 | 10.94 | 11.19 |
| | Tg | 48° C. | 48° C. | 38° C. | 72° C. |
| Crystalline polyester resin C | Type | C-1 | C-1 | C-1 | C-1 |
| | Diol | Hexanediol 100% | Hexanediol 100% | Hexanediol 100% | Hexanediol 100% |
| | Dicarboxylic acid | Dodecanedionic acid 100% | Dodecanedionic acid 100% | Dodecanedionic acid 100% | Dodecanedionic acid 100% |
| | SP3 | 9.71 | 9.71 | 9.71 | 9.71 |
| | Mw | 15,000 | 15,000 | 15,000 | 15,000 |
| | Mp | 70° C. | 70° C. | 70° C. | 70° C. |
| Component ratio (mass %) | Resin A | 15 | 15 | 15 | 30 |
| | Resin B | 70 | 70 | 70 | 55 |
| | Resin C | 5 | 5 | 5 | 5 |
| | Releasing agent | 5 | 5 | 5 | 5 |
| | Colorant | 5 | 5 | 5 | 5 |
| SP value | SP1 − SP3 | 1.52 | 0.07 | 0.88 | 0.88 |
| | SP2 − SP1 | −0.16 | 1.29 | 0.35 | 0.60 |
| Phase of probe in tapping mode of AFM | A (deg) | 58 | 74 | 70 | 70 |
| | B (deg) | 61 | 61 | 65 | 57 |
| | C (deg) | 68 | 68 | 68 | 68 |
| | A − B (deg) | −3 | 13 | 5 | 13 |
| Area ratio | (%) | 22 | 22 | 22 | 38 |
| Measurement and evaluation result | Tg1st | 36 | 24 | 22 | 38 |
| | Tg2nd | 18 | 12 | 10 | 22 |
| | Min. fixing | 120° C. | 95° C. | 95° C. | 120° C. |
| | Max. fixing | 180° C. | 170° C. | 170° C. | 190° C. |
| | Heat resistant storage stability | B | C | D | A |
| | Anti-filming | B | C | D | A |

| | | Comp. Ex. 5 | Comp. Ex. 6 | Comp. Ex. 7 |
|---|---|---|---|---|
| Toner No. | | 12 | 13 | 14 |
| Non-crystalline polyester resin A | Type | A'-1 | A'-2 | A-1 |
| | Mw | 120,000 | 100,000 | 150,000 |
| | Diol | 3-methyl-1,5-pentanediol 100% | 3-methyl-1,5-pentanediol 100% | 3-methyl-1,5-pentanediol 100% |
| | Dicarboxylic acid | Isophthalic acid 100% | Decanedioic acid 100% | Isophthalic acid 40%/Adipic acid 60% |
| | SP1 | 11.23 | 9.78 | 10.59 |
| | Tg | 5° C. | −65° C. | −40° C. |
| Non-crystalline polyester resin B | Type | B-1 | B-1 | B-1 |
| | Mw | 5,000 | 5,000 | 5,000 |
| | Diol | BisA-EO 85%/ BisA-PO15% | BisA-EO 85%/ BisA-PO15% | BisA-EO 85%/ BisA-PO 15% |
| | Dicarboxylic acid | Isophthalic acid 80%/Adipic acid 20% | Isophthalic acid 80%/Adipic acid 20% | Isophthalic acid 80%/Adipic acid 20% |
| | SP2 | 11.07 | 11.07 | 11.07 |
| | Tg | 48° C. | 48° C. | 48° C. |
| Crystalline polyester resin C | Type | C-1 | C-1 | — |
| | Diol | Hexanediol 100% | Hexanediol 100% | |
| | Dicarboxylic acid | Dodecanedionic acid 100% | Dodecanedionic acid 100% | |
| | SP3 | 9.71 | 9.71 | |
| | Mw | 15,000 | 15,000 | |
| | Mp | 70° C. | 70° C. | |
| Component ratio (mass %) | Resin A | 10 | 20 | 15 |
| | Resin B | 75 | 65 | 75 |
| | Resin C | 5 | 5 | 0 |
| | Releasing agent | 5 | 5 | 5 |
| | Colorant | 5 | 5 | 5 |
| SP value | SP1 − SP3 | 1.52 | 0.07 | — |
| | SP2 − SP1 | −0.16 | 1.29 | 0.48 |

TABLE 1-2-continued

| | | | | |
|---|---|---|---|---|
| Phase of probe in tapping mode of AFM | A (deg) | 58 | 74 | 70 |
| | B (deg) | 61 | 61 | 61 |
| | C (deg) | 68 | 68 | — |
| | A − B (deg) | −3 | 13 | 9 |
| Area ratio | (%) | 18 | 30 | 18 |
| Measurement and evaluation result | Tg1st | 42 | 18 | 30 |
| | Tg2nd | 22 | 8 | 28 |
| | Min. fixing | 125° C. | 95° C. | 125° C. |
| | Max. fixing | 190° C. | 170° C. | 190° C. |
| | Heat resistant storage stability | B | D | A |
| | Anti-filming | B | D | A |

TABLE 1-3

| | | Ex. 8 | Ex. 9 | Ex. 10 | Ex. 11 |
|---|---|---|---|---|---|
| Toner No. | | 15 | 16 | 17 | 18 |
| Non-crystalline polyester resin A | Type | A-4 | A-5 | A-6 | A-6 |
| | Mw | 150,000 | 120,000 | 130,000 | 130,000 |
| | Diol | 3-methyl-1,5-pentanediol 100% | 3-methyl-1,5-pentanediol 100% | 3-methyl-1,5-pentanediol 100% | 3-methyl-1,5-pentanediol 100% |
| | Dicarboxylic acid | Isophthalic acid 28%/Adipic acid 72% | Isophthalic acid 22%/Adipic acid 78% | Isophthalic acid 55%/Adipic acid 45% | Isophthalic acid 55%/Adipic acid 45% |
| | SP1 | 10.46 | 10.40 | 10.75 | 10.75 |
| | Tg | −45° C. | −48° C. | −35° C. | −35° C. |
| Non crystalline polyester resin B | Type | B-4 | B-4 | B-4 | B-5 |
| | Mw | 5,000 | 5,000 | 5,000 | 5,000 |
| | Diol | BisA-EO 80%/BisA-PO 20% | BisA-EO 80%/BisA-PO 20% | BisA-EO 80%/BisA-PO 20% | BisA-EO 80%/BisA-PO 20% |
| | Dicarboxylic acid | Isophthalic acid 85%/Adipic acid 15% | Isophthalic acid 85%/Adipic acid 15% | Isophthalic acid 85%/Adipic acid 15% | Isophthalic acid 74%/Adipic acid 26% |
| | SP2 | 11.13 | 11.13 | 11.13 | 10.97 |
| | Tg | 50° C. | 50° C. | 50° C. | 46° C. |
| Crystalline polyester resin C | Type | C-1 | C-4 | C-1 | C-1 |
| | Diol | Hexanediol 100% | Hexanediol 100% | Hexanediol 100% | Hexanediol 100% |
| | Dicarboxylic acid | Dodecanedionic acid 100% | Octanedioic acid 100% | Dodecanedionic acid 100% | Dodecanedionic acid 100% |
| | SP3 | 9.71 | 10.02 | 9.71 | 9.71 |
| | Mw | 15,000 | 15,000 | 15,000 | 15,000 |
| | Mp | 70° C. | 63° C. | 70° C. | 70° C. |
| Component ratio (mass %) | Resin A | 15 | 15 | 15 | 15 |
| | Resin B | 70 | 70 | 70 | 70 |
| | Resin C | 5 | 5 | 5 | 5 |
| | Releasing agent | 5 | 5 | 5 | 5 |
| | Colorant | 5 | 5 | 5 | 5 |
| SP value | SP1 − SP3 | 0.75 | 0.38 | 1.04 | 1.04 |
| | SP2 − SP1 | 0.67 | 0.73 | 0.38 | 0.22 |
| Phase of probe in tapping mode of AFM | A (deg) | 70 | 72 | 65 | 65 |
| | B (deg) | 60 | 60 | 60 | 60 |
| | C (deg) | 68 | 67 | 68 | 68 |
| | A − B (deg) | 10 | 12 | 5 | 5 |
| Area ratio | (%) | 22 | 22 | 22 | 22 |
| Measurement and evaluation result | Tg1st | 32 | 30 | 34 | 31 |
| | Tg2nd | 16 | 15 | 18 | 16 |
| | Min. fixing | 95° C. | 95° C. | 100° C. | 95° C. |
| | Max. fixing | 190° C. | 185° C. | 185° C. | 180° C. |
| | Heat resistant storage stability | A | A | B | B |
| | Anti-filming | A | A | A | A |

| | | Ex. 12 | Ex. 13 | Ex 14 | Ex. 15 |
|---|---|---|---|---|---|
| Toner No. | | 19 | 20 | 21 | 22 |
| Non-crystalline polyester resin A | Type | A-4 | A-4 | A-4 | A-5 |
| | Mw | 150,000 | 150,000 | 150,000 | 120,000 |
| | Diol | 3-methyl-1,5-pentanediol 100% | 3-methyl-1,5-pentanediol 100% | 3-methyl-1,5-pentanediol 100% | 3-methyl-1,5-pentanediol 100% |

TABLE 1-3-continued

| | | | | | |
|---|---|---|---|---|---|
| | Dicarboxylic acid | Isophthalic acid 28%/ Adipic acid 72% | Isophthalic acid 28%/Adipic acid 72% | Isophthalic acid 28%/Adipic acid 72% | Isophthalic acid 22%/Adipic acid 78% |
| | SP1 | 10.46 | 10.46 | 10.46 | 10.40 |
| | Tg | −45° C. | −45° C. | −45° C. | −48° C. |
| Non-crystalline polyester resin B | Type | B-4 | B-4 | B-4 | B-4 |
| | Mw | 5,000 | 5,000 | 5,000 | 5,000 |
| | Diol | BisA-EO 80%/ BisA-PO 20% | BisA-EO 80%/ BisA-PO 20% | BisA-EO 80%/ BisA-PO 20% | BisA-EO 80%/ BisA-PO 20% |
| | Dicarboxylic acid | Isophthalic acid 85%/ Adipic acid 15% | Isophthalic acid 85%/Adipic acid 15% | Isophthalic acid 85%/Adipic acid 15% | Isophthalic acid 85%/Adipic acid 15% |
| | SP2 | 11.13 | 11.13 | 11.13 | 11.13 |
| | Tg | 50° C. | 50° C. | 50° C. | 50° C. |
| Crystalline polyester resin C | Type | C-5 | C-1 | C-1 | C-5 |
| | Diol | Ethylene glycol 100% | Hexanediol 100% | Hexanediol 100% | Ethylene glycol 100% |
| | Dicarboxylic acid | Decanedioic acid 100% | Dodecanedionic acid 100% | Dodecanedionic acid 100% | Decanedioic acid 100% |
| | SP3 | 10.24 | 9.71 | 9.71 | 10.24 |
| | Mw | 15,000 | 15,000 | 15,000 | 15,000 |
| | Mp | 72° C. | 70° C. | 70° C. | 72° C. |
| Component ratio (mass %) | Resin A | 15 | 3 | 18 | 15 |
| | Resin B | 70 | 86 | 66 | 70 |
| | Resin C | 5 | 1 | 6 | 5 |
| | Releasing agent | 5 | 5 | 5 | 5 |
| | Colorant | 5 | 5 | 5 | 5 |
| SP value | SP1 − SP3 | 0.22 | 0.75 | 0.75 | 0.16 |
| | SP2 − SP1 | 0.67 | 0.67 | 0.67 | 0.73 |
| Phase of probe in tapping mode of AFM | A (deg) | 70 | 70 | 70 | 62 |
| | B (deg) | 60 | 60 | 60 | 60 |
| | C (deg) | 68 | 68 | 68 | 62 |
| | A − B (deg) | 10 | 10 | 10 | 2 |
| Area ratio | (%) | 22 | 5 | 35 | 22 |
| Measurement and evaluation result | Tg1st | 32 | 39 | 29 | 30 |
| | Tg2nd | 18 | 18 | 14 | 17 |
| | Min. fixing | 95° C. | 100° C. | 95° C. | 100° C. |
| | Max. fixing | 180° C. | 180° C. | 190° C. | 180° C. |
| | Heat resistant storage stability | B | B | B | B |
| | Anti-filming | A | A | B | B |

TABLE 1-4

| | | Ex. 16 | Ex. 17 | Ex. 18 | Ex. 19 | Ex. 20 |
|---|---|---|---|---|---|---|
| Toner No. | | 23 | 24 | 25 | 26 | 27 |
| Non-crystalline polyester resin A | Type | A-7 | A-4 | A-4 | A-8 | A-9 |
| | Mw | 130,000 | 150,000 | 150,000 | 120,000 | 130,000 |
| | Diol | 3-methyl-1,5-pentanediol 100% | 3-methyl-1,5-pentanediol 100% | 3-methyl-1,5-pentanediol 100% | 3-methyl-1,5-pentanediol 100% | 3-methyl-1,5-pentanediol 100% |
| | Dicarboxylic acid | Isophthalic acid 60%/Adipic acid 40% | Isophthalic acid 28%/ Adipic acid 72% | Isophthalic acid 28%/ Adipic acid 72% | Isophthalic acid 25%/ Adipic acid 75% | Isophthalic acid 52%/ Adipic acid 48% |
| | SP1 | 10.81 | 10.46 | 10.46 | 10.44 | 10.72 |
| | Tg | −30° C. | −45° C. | −45° C. | −48° C. | −35° C. |
| Non-crystalline polyester resin B | Type | B-5 | B-4 | B-4 | B-4 | B-4 |
| | Mw | 5,000 | 5,000 | 5,000 | 5,000 | 5,000 |
| | Diol | Bis A-EO 80%/ Bis A-PO 20% | Bis A-EO 80%/ Bis A-PO 20% | Bis A-EO 80%/Bis A-PO 20% | Bis A-EO 80%/Bis A-PO 20% | Bis A-EO 80%/ Bis A-PO 20% |
| | Dicarboxylic acid | Isophthalic acid 74%/Adipic acid 26% | Isophthalic acid 85%/ Adipic acid 15% | Isophthalic acid 85%/ Adipic acid 15% | Isophthalic acid 85%/ Adipic acid 15% | Isophthalic acid 85%/ Adipic acid 15% |
| | SP2 | 10.97 | 11.13 | 11.13 | 11.13 | 11.13 |
| | Tg | 46° C. | 50° C. | 50° C. | 50° C. | 50° C. |
| Crystalline polyester resin C | Type | C-1 | C-1 | C-1 | C-4 | C-1 |
| | Diol | Hexanediol 100% | Hexanediol 100% | Hexanediol 100% | Hexanediol 100% | Hexanediol 100% |
| | Dicarboxylic acid | Dodecanedionic acid 100% | Dodecanedionic acid 100% | Dodecanedionic acid 100% | Octanedioic acid 100% | Dodecanedionic acid 100% |

TABLE 1-4-continued

| | | | | | | |
|---|---|---|---|---|---|---|
| | SP3 | 9.71 | 9.71 | 9.71 | 10.02 | 9.71 |
| | Mw | 15,000 | 15,000 | 15,000 | 15,000 | 15,000 |
| | Mp | 70° C. | 70° C. | 70° C. | 63° C. | 70° C. |
| Component ratio (mass %) | Resin A | 15 | 2 | 19 | 15 | 15 |
| | Resin B | 70 | 87 | 64 | 70 | 70 |
| | Resin C | 5 | 1 | 7 | 5 | 5 |
| | Releasing agent | 5 | 5 | 5 | 5 | 5 |
| | Colorant | 5 | 5 | 5 | 5 | 5 |
| SP value | SP1 − SP3 | 1.10 | 0.75 | 0.75 | 0.42 | 1.01 |
| | SP2 − SP1 | 0.16 | 0.67 | 0.67 | 0.69 | 0.41 |
| Phase of probe in tapping mode of AFM | A (deg) | 63 | 70 | 70 | 70 | 70 |
| | B (deg) | 60 | 60 | 60 | 60 | 60 |
| | C (deg) | 63 | 68 | 68 | 67 | 68 |
| | A − B (deg) | 3 | 10 | 10 | 10 | 10 |
| Area ratio | (%) | 22 | 4 | 36 | 22 | 22 |
| Measurement and evaluation result | Tg1st | 31 | 39 | 29 | 32 | 31 |
| | Tg2nd | 18 | 18 | 14 | 16 | 15 |
| | Min. fixing | 100° C. | 105° C. | 100° C. | 95° C. | 95° C. |
| | Max. fixing | 180° C. | 180° C. | 190° C. | 195° C. | 185° C. |
| | Heat resistant storage stability | B | B | B | A | A |
| | Anti-filming | B | B | B | A | A |

| | | Ex. 21 | Ex. 22 | Ex. 23 | Ex. 24 |
|---|---|---|---|---|---|
| Toner No. | | 28 | 29 | 30 | 31 |
| Non-crystalline polyester resin A | Type | A-1 | A-1 | A-1 | A-1 |
| | Mw | 150,000 | 150,000 | 150,000 | 150,000 |
| | Diol | 3-methyl-1,5-pentanediol 100% | 3-methyl-1,5-pentanediol 100% | 3-methyl-1,5-pentanediol 100% | 3-methyl-1,5-pentanediol 100% |
| | Dicarboxylic acid | Isophthalic acid 40%/Adipic acid 60% | Isophthalic acid 40%/Adipic acid 60% | Isophthalic acid 40%/Adipic acid 60% | Isophthalic acid 40%/Adipic acid 60% |
| | SP1 | 10.59 | 10.59 | 10.59 | 10.59 |
| | Tg | −40° C. | −40° C. | −40° C. | −40° C. |
| Non-crystalline polyester resin B | Type | B-1 | B-1 | B-1 | B-1 |
| | Mw | 5,000 | 5,000 | 5,000 | 5,000 |
| | Diol | BisA-EO 85%/BisA-PO 15% | BisA-EO 85%/BisA-PO 15% | BisA-EO 85%/BisA-PO 15% | BisA-EO 85%/BisA-PO 15% |
| | Dicarboxylic acid | Isophthalic acid 80%/Adipic acid 20% | Isophthalic acid 80%/Adipic acid 20% | Isophthalic acid 80%/Adipic acid 20% | Isophthalic acid 80%/Adipic acid 20% |
| | SP2 | 11.07 | 11.07 | 11.07 | 11.07 |
| | Tg | 48° C. | 48° C. | 48° C. | 48° C. |
| Crystalline polyester resin C | Type | C-1 | C-1 | C-1 | C-1 |
| | Diol | Hexanediol 100% | Hexanediol 100% | Hexanediol 100% | Hexanediol 100% |
| | Dicarboxylic acid | Dodecanedionic acid 100% | Dodecanedionic acid 100% | Dodecanedionic acid 100% | Dodecanedionic acid 100% |
| | SP3 | 9.71 | 9.71 | 9.71 | 9.71 |
| | Mw | 15,000 | 15,000 | 15,000 | 15,000 |
| | Mp | 70° C. | 70° C. | 70° C. | 70° C. |
| Component ratio (mass %) | Resin A | 18 | 10 | 9 | 20 |
| | Resin B | 66 | 76 | 78 | 64 |
| | Resin C | 6 | 4 | 3 | 6 |
| | Releasing agent | 5 | 5 | 5 | 5 |
| | Colorant | 5 | 5 | 5 | 5 |
| SP value | SP1 − SP3 | 0.88 | 0.88 | 0.88 | 0.88 |
| | SP2 − SP1 | 0.48 | 0.48 | 0.48 | 0.48 |
| Phase of probe in tapping mode of AFM | A (deg) | 70 | 70 | 70 | 70 |
| | B (deg) | 61 | 61 | 61 | 61 |
| | C (deg) | 68 | 68 | 68 | 68 |
| | A − B (deg) | 9 | 9 | 9 | 9 |
| Area ratio | (%) | 25 | 15 | 14 | 26 |
| Measurement and evaluation result | Tg1st | 30 | 32 | 32 | 30 |
| | Tg2nd | 15 | 16 | 21 | 14 |
| | Min. fixing | 95° C. | 95° C. | 105° C. | 95° C. |
| | Max. fixing | 190° C. | 190° C. | 190° C. | 190° C. |
| | Heat resistant storage stability | A | A | A | B |
| | Anti-filming | A | A | A | B |

TABLE 1-5

| | | Ex. 25 | Ex. 26 | Comp. Ex. 8 | Comp. Ex. 9 |
|---|---|---|---|---|---|
| Toner No. | | 32 | 33 | 34 | 35 |
| Non-crystalline polyester resin A | Type | A-10 | A-11 | A'-3 | A'-4 |
| | Mw | 150,000 | 150,000 | 120,000 | 100,000 |
| | Diol | 3-methyl-1,5-pentanediol 55%/BisA-EO 45% | 3-methyl-1,5-pentanediol 45%/BisA-EO 55% | BisA-EO 80%/3-methyl-1,5-pentanediol 20% | 3-methyl-1,5-pentanediol 100% |
| | Dicarboxylic acid | Isophthalic acid 40%/Adipic acid 60% | Isophthalic acid 40%/Adipic acid 60% | Isophthalic acid 50%/Adipic acid 50% | Adipic acid 100% |
| | SP1 | 10.51 | 10.49 | 10.51 | 10.16 |
| | Tg | −30° C. | −20° C. | 4° C. | −62° C. |
| Non-crystalline polyester resin B | Type | B-1 | B-1 | B-4 | B-4 |
| | Mw | 5,000 | 5,000 | 5,000 | 5,000 |
| | Diol | BisA-EO 85%/BisA-PO 15% | BisA-EO 85%/BisA-PO 15% | BisA-EO 80%/BisA-PO 20% | BisA-EO 80%/BisA-PO 20% |
| | Dicarboxylic acid | Isophthalic acid 80%/Adipic acid 20% | Isophthalic acid 80%/Adipic acid 20% | Isophthalic acid 85%/Adipic acid 15% | Isophthalic acid 85%/Adipic acid 15% |
| | SP2 | 11.07 | 11.07 | 11.13 | 11.13 |
| | Tg | 48° C. | 48° C. | 50° C. | 50° C. |
| Crystalline polyester resin C | Type | C-1 | C-1 | C-1 | C-1 |
| | Diol | Hexanediol 100% | Hexanediol 100% | Hexanediol 100% | Hexanediol 100% |
| | Dicarboxylic acid | Dodecanedionic acid 100% | Dodecanedionic acid 100% | Dodecanedionic acid 100% | Dodecanedionic acid 100% |
| | SP3 | 9.71 | 9.71 | 9.71 | 9.71 |
| | Mw | 15,000 | 15,000 | 15,000 | 15,000 |
| | Mp | 70° C. | 70° C. | 70° C. | 70° C. |
| Component ratio (mass %) | Resin A | 15 | 15 | 15 | 25 |
| | Resin B | 70 | 70 | 70 | 60 |
| | Resin C | 5 | 5 | 5 | 5 |
| | Releasing agent | 5 | 5 | 5 | 5 |
| | Colorant | 5 | 5 | 5 | 5 |
| SP value | SP1 − SP3 | 0.80 | 0.78 | 0.80 | 0.45 |
| | SP2 − SP1 | 0.56 | 0.58 | 0.62 | 0.97 |
| Phase of probe in tapping mode of AFM | A (deg) | 70 | 70 | 52 | 80 |
| | B (deg) | 61 | 61 | 60 | 60 |
| | C (deg) | 68 | 68 | 68 | 68 |
| | A − B (deg) | 9 | 9 | −8 | 20 |
| Area ratio | (%) | 14 | 26 | 22 | 22 |
| Measurement and evaluation result | Tg1st | 30 | 30 | 45 | 23 |
| | Tg2nd | 15 | 15 | 20 | 10 |
| | Min. fixing | 95° C. | 105° C. | 125° C. | 95° C. |
| | Max. fixing | 190° C. | 190° C. | 190° C. | 160° C. |
| | Heat resistant storage stability | A | B | B | D |
| | Anti-filming | A | B | B | D |

| | | Comp. Ex. 10 | Comp. Ex. 12 | Comp. Ex. 13 |
|---|---|---|---|---|
| | Toner No. | 36 | 38 | 39 |
| Non-crystalline polyester resin A | Type | — | A'-5 | A'-6 |
| | Mw | | 150,000 | 120,000 |
| | Diol | | 3-methyl-1,5-pentanediol 100% | BisA-EO 80%/BisA-PO 20% |
| | Dicarboxylic acid | | Isophthalic acid 40%/Adipic acid 60% | Isophthalic acid 85%/Adipic acid 15% |
| | SP1 | | 10.57 | 11.15 |
| | Tg | | −40° C. | 52° C. |
| Non-crystalline polyester resin B | Type | B-4 | B-1 | B-1 |
| | Mw | 5,000 | 5,000 | 5,000 |
| | Diol | BisA-EO 80%/BisA-PO 20% | BisA-EO 85%/BisA-PO 15% | BisA-EO 85%/BisA-PO 15% |
| | Dicarboxylic acid | Isophthalic acid 85%/Adipic acid 15% | Isophthalic acid 80%/Adipic acid 20% | Isophthalic acid 80%/Adipic acid 20% |
| | SP2 | 11.13 | 11.07 | 11.07 |
| | Tg | 50° C. | 48° C. | 48° C. |
| Crystalline polyester resin C | Type | — | C-1 | C-1 |
| | Diol | | Hexanediol 100% | Hexanediol 100% |
| | Dicarboxylic acid | | Dodecanedionic acid 100% | Dodecanedionic acid 100% |

TABLE 1-5-continued

| | | | | |
|---|---|---|---|---|
| | SP3 | | 9.71 | 9.71 |
| | Mw | | 15,000 | 15,000 |
| | Mp | | 70° C. | 70° C. |
| Component ratio (mass %) | Resin A | 0 | 15 | 15 |
| | Resin B | 88 | 70 | 70 |
| | Resin C | 0 | 5 | 5 |
| | Releasing agent | 6 | 5 | 5 |
| | Colorant | 6 | 5 | 5 |
| SP value | SP1 − SP3 | — | 0.86 | 1.44 |
| | SP2 − SP1 | — | 0.50 | −0.08 |
| Phase of probe in tapping mode of AFM | A (deg) | — | 70 | 59 |
| | B (deg) | 60 | 61 | 61 |
| | C (deg) | — | 68 | 68 |
| | A − B (deg) | — | 9 | −2 |
| Area ratio | (%) | 0 | 22 | 22 |
| Measurement and evaluation result | Tg1st | 47 | 30 | 55 |
| | Tg2nd | 23 | 15 | 40 |
| | Min. fixing | 140° C. | 95° C. | 130° C. |
| | Max. fixing | 160° C. | 190° C. | 190° C. |
| | Heat resistant storage stability | D | D | A |
| | Anti-filming | B | C | A |

In Tables 1-1 to 1-5, "component ratio (% by mass)" is a component ratio (% by mass) of each of the resin A, resin B, resin C, releasing agent, and colorant, relative to a total amount.

The "area ratio" is a ratio [(area of resin A or A'+area of resin C)/area of toner] of a total area of the area of islands of the non-crystalline polyester resin A or A' and the area of islands of the crystalline polyester resin C, relative to the total area of the toner in the transmission electron microscopic (TEM) image.

The "BisA-EO" denotes a bisphenol A ethylene oxide 2 mol adduct. The "BisA-PO" denotes a bisphenol A propylene oxide 3 mol adduct. The "hexanediol" denotes 1,6-hexanediol. The "butane diol" denotes 1,4-butanediol. The unit "%" in the formulation of diol and dicarboxylic acid of each resin is "mol %."

It was confirmed from the results of Examples 1 to 26 and Comparative Examples 1 to 13 that the toner of the present invention has excellent low temperature fixing ability, hot offset resistance, and heat resistant storage stability without causing filming.

For example, in Example 1, the minimum fixing temperature was 95° C., and low temperature fixing ability was very good. On the other hand, in Comparative Example 1, the minimum fixing temperature was 120° C., and therefore low temperature fixing ability was insufficient.

Moreover, Comparative Example 12, in which a linear chain reactive precursor was used as a starting material of the non-crystalline polyester resin, resulted in poor heat resistant storage stability, and anti-filming properties.

Examples satisfying both the formula (1) and the formula (2) (e.g., Examples 9 to 12) had more excellent results in heat resistant storage stability or anti-filming properties, compared to Examples not satisfying either the formula (1) or the formula (2) (e.g., Examples 15 and 16).

Examples satisfying both the formula (3) and the formula (4) (e.g., Examples 8 and 9) had more excellent results in low temperature fixing ability, heat resistant storage stability, and anti-filming properties, compared to Examples not satisfying either the formula (3) or the formula (4) (e.g., Examples 15 and 16).

Examples having the area ratio of 5% to 35% (e.g., Examples 13 and 14) had more excellent results in low temperature fixing ability, or anti-filming properties, compared to Example having the area ratio of less than 5% (e.g., Example 17) and Example having the area ratio of more than 35% (e.g., Example 18).

Examples having the area ratio of 15% to 25% (e.g., Examples 1, 21, and 22) have highly excellent results in low temperature fixing ability, hot offset resistance, heat resistant storage stability, and anti-filming properties.

Examples in which the diol component, which was a constitutional component of the non-crystalline polyester resin A, contained 50% by mass or greater of C4-C12 aliphatic diol (e.g., Examples 1 and 25) had more excellent results in low temperature fixing ability, heat resistant storage stability, and anti-filming properties, compared to Example in which the diol component, which was a constitutional component of the non-crystalline polyester resin A, contained less than 50% by mass of C4-C12 aliphatic diol (e.g., Example 26).

The embodiments of the present invention are as follows:

<1> A toner, containing:

a non-crystalline polyester resin A obtained through a reaction between a non-linear chain reactive precursor and a curing agent, and having a glass transition temperature of −60° C. to 0° C.;

a non-crystalline polyester resin B having a glass transition temperature of 40° C. to 70° C.; and a crystalline polyester resin C, wherein the toner has a glass transition temperature Tg1st of 20° C. to 40° C. as measured with first heating in differential scanning calorimetry (DSC).

<2> The toner according to <1>, wherein the toner satisfies relationships represented by the following formulae 1 and 2:

$$SP1-SP3>0.2 \quad \text{Formula 1}$$

$$SP2-SP1>0.2 \quad \text{Formula 2}$$

where SP1 is an SP value of the non-crystalline polyester resin A, SP2 is an SP value of the non-crystalline polyester resin B, and SP3 is an SP value of the crystalline polyester resin C.

<3> The toner according to any of <1> or <2>, wherein the toner satisfies relationships represented by the following formulae 3 and 4:

$$A \geq C > B \quad \text{Formula 3}$$

$$A-B \geq 5 \quad \text{Formula 4}$$

where A is a phase of a probe when the non-crystalline polyester resin A is measured by atomic force microscopy (AFM) of a tapping mode, B is a phase of a probe when the non-crystalline polyester resin B is measured by atomic force microscopy (AFM) of a tapping mode, and C is a phase of a probe when the crystalline polyester resin C is measured by atomic force microscopy (AFM) of a tapping mode.

<4> The toner according to <3>, wherein the non-crystalline polyester resin A and the crystalline polyester resin C are each separately present as islands in a continuous phase of the non-crystalline polyester resin B, as observed on a transmission electron microscopic (TEM) image of the toner, where a ratio of a sum of an area of the non-crystalline polyester resin A and an area of the crystalline polyester resin C to an area of the toner, which is represented by [(area of non-crystalline polyester resin A+area of crystalline polyester resin C)/area of toner], is 5% to 35%.

<5> The toner according to any one of <1> to <4>, wherein a difference between the glass transition temperature Tg1st of the toner and a glass transition temperature Tg2nd of the toner, which is represented by Tg1st−Tg2nd, is 10° C. or greater, where the Tg1st is the glass transition temperature of the toner as measured with the first heating in differential scanning calorimetry (DSC), and the Tg2nd is a glass transition temperature of the toner as measured with second heating in differential scanning calorimetry (DSC), and wherein the crystalline polyester resin C has a melting point of 60° C. to 80° C.

<6> The toner according to any one of <1> to <5>, wherein the non-crystalline polyester resin A contains a diol component as a constitutional component of the non-crystalline polyester resin A, and the diol component contains C4-C12 aliphatic diol in an amount of 50% by mass or greater.

<7> The toner according to any one of <1> to <6>, wherein the non-crystalline polyester resin A contains a dicarboxylic acid component as a constitutional component of the non-crystalline polyester resin A, and the dicarboxylic acid contains C4-C12 aliphatic dicarboxylic acid in an amount of 50% by mass or greater.

<8> The toner according to any one of <1> to <7>, wherein the crystalline polyester resin C is synthesized from C4-C12 linear chain saturated aliphatic dicarboxylic acid and C2-C12 linear chain saturated aliphatic diol.

<9> The toner according to any one of <1> to <8>, wherein the non-crystalline polyester resin A contains 50% by mass of C4-C12 aliphatic diol relative to a total amount of alcohol components.

<10> A developer, containing:

the toner, as defined in any one of <1> to <9>.

This application claims priority to Japanese application No. 2011-191681, filed on Sep. 2, 2011, and incorporated herein by reference.

What is claimed is:

1. A toner, comprising:

a non-crystalline polyester resin A having a branched chain structure, and having a glass transition temperature of −60° C. to 0° C.;

a non-crystalline polyester resin B having a glass transition temperature of 40° C. to 70° C.; and a crystalline polyester resin C, wherein the toner has a glass transition temperature Tg1st of 20° C. to 40° C. as measured with first heating in differential scanning calorimetry (DSC).

2. The toner according to claim 1, wherein the toner satisfies relationships represented by the following formulae 1 and 2:

$$SP1-SP3>0.2 \quad \text{Formula 1}$$

$$SP2-SP1>0.2 \quad \text{Formula 2}$$

where SP1 is an SP value of the non-crystalline polyester resin A, SP2 is an SP value of the non-crystalline polyester resin B, and SP3 is an SP value of the crystalline polyester resin C.

3. The toner according to claim 1, wherein the toner satisfies relationships represented by the following formulae 3 and 4:

$$A \geq C > B \quad \text{Formula 3}$$

$$A-B \geq 5 \quad \text{Formula 4}$$

where A is a phase of a probe when the non-crystalline polyester resin A is measured by atomic force microscopy (AFM) of a tapping mode, B is a phase of a probe when the non-crystalline polyester resin B is measured by atomic force microscopy (AFM) of a tapping mode, and C is a phase of a probe when the crystalline polyester resin C is measured by atomic force microscopy (AFM) of a tapping mode.

4. The toner according to claim 3, wherein the non-crystalline polyester resin A and the crystalline polyester resin C are each separately present as islands in a continuous phase of the non-crystalline polyester resin B, as observed on a transmission electron microscopic (TEM) image of the toner, where a ratio of a sum of an area of the non-crystalline polyester resin A and an area of the crystalline polyester resin C to an area of the toner, which is represented by [(area of non-crystalline polyester resin A+area of crystalline polyester resin C)/area of toner], is 5% to 35%.

5. The toner according to claim 1, wherein a difference between the glass transition temperature Tg1st of the toner and a glass transition temperature Tg2nd of the toner, which is represented by Tg1st−Tg2nd, is 10° C. or greater, where the Tg1st is the glass transition temperature of the toner as measured with the first heating in differential scanning calorimetry (DSC), and the Tg2nd is a glass transition temperature of the toner as measured with second heating in differential scanning calorimetry (DSC), and wherein the crystalline polyester resin C has a melting point of 60° C. to 80° C.

6. The toner according to claim 1, wherein the non-crystalline polyester resin A contains a diol component as a constitutional component of the non-crystalline polyester resin A, and the diol component contains C4-C12 aliphatic diol in an amount of 50% by mass or greater.

7. The toner according to claim 1, wherein the non-crystalline polyester resin A contains a dicarboxylic acid component as a constitutional component of the non-crystalline polyester resin A, and the dicarboxylic acid contains C4-C12 aliphatic dicarboxylic acid in an amount of 50% by mass or greater.

8. The toner according to claim 1, wherein the crystalline polyester resin C is synthesized from C4-C12 linear chain saturated aliphatic dicarboxylic acid and C2-C12linear chain saturated aliphatic diol.

9. The toner according to claim 1, wherein the non-crystalline polyester resin A contains 50% by mass of C4-C12 aliphatic diol relative to a total amount of alcohol components.

10. A developer, comprising:

a toner, which contains:

a non-crystalline polyester resin A having a branched chain structure, and having a glass transition temperature of −60° C. to 0° C.;

a non-crystalline polyester resin B having a glass transition temperature of 40° C. to 70° C.; and a crystalline polyester resin C, wherein the toner has a glass transition temperature Tg1st of 20° C. to 40° C. as measured with first heating in differential scanning calorimetry (DSC).

11. The toner according to claim 1, wherein the non-crystalline polyester resin A has a weight average molecular weight of 20,000 to 1,000,000.

12. The toner according to claim 1, wherein the non-crystalline polyester resin A contains a urethane bond or a urea bond, or both a urethane bond and a urea bond.

* * * * *